US010242649B2

(12) United States Patent
Chappalli et al.

(10) Patent No.: US 10,242,649 B2
(45) Date of Patent: Mar. 26, 2019

(54) REDUCED FOOTPRINT PIXEL RESPONSE CORRECTION SYSTEMS AND METHODS

(71) Applicant: Apple Inc., Cupertino, CA (US)

(72) Inventors: Mahesh B. Chappalli, San Jose, CA (US); Chaohao Wang, Sunnyvale, CA (US); Guy Côté, Aptos, CA (US); Marc Albrecht, San Francisco, CA (US)

(73) Assignee: Apple Inc., Cupertino, CA (US)

( * ) Notice: Subject to any disclaimer, the term of this patent is extended or adjusted under 35 U.S.C. 154(b) by 10 days.

(21) Appl. No.: 15/664,940

(22) Filed: Jul. 31, 2017

(65) Prior Publication Data

US 2018/0090102 A1 Mar. 29, 2018

Related U.S. Application Data

(60) Provisional application No. 62/398,698, filed on Sep. 23, 2016.

(51) Int. Cl.

| | |
|---|---|
| ***G09G 5/10*** | (2006.01) |
| ***G09G 5/00*** | (2006.01) |
| *G09G 3/36* | (2006.01) |
| *G09G 5/36* | (2006.01) |

(52) U.S. Cl.

CPC ..... *G09G 5/10* (2013.01); *G09G 5/003* (2013.01); *G09G 3/3611* (2013.01); *G09G 3/3614* (2013.01); *G09G 5/363* (2013.01); *G09G 2310/0254* (2013.01); *G09G 2320/0233* (2013.01); *G09G 2320/0257* (2013.01); *G09G 2320/0276* (2013.01); *G09G 2320/041* (2013.01); *G09G 2320/0646* (2013.01); *G09G 2330/023* (2013.01); *G09G 2340/0435* (2013.01); *G09G 2360/144* (2013.01)

(58) Field of Classification Search

CPC ..... G09G 2320/0252; G09G 2320/0233

See application file for complete search history.

(56) References Cited

U.S. PATENT DOCUMENTS

| | | | | |
|---|---|---|---|---|
| 7,068,392 | B2 | 6/2006 | Chiu | |
| 7,924,248 | B2 | 4/2011 | Uchida et al. | |
| 7,924,298 | B2 | 4/2011 | Uchida et al. | |
| 8,587,502 | B2 | 11/2013 | Hongo et al. | |
| 9,324,263 | B2 | 4/2016 | Sugimoto et al. | |
| 9,336,705 | B2 * | 5/2016 | Inoue | G09G 3/2003 |

(Continued)

*Primary Examiner* — Thomas J Lett

(74) *Attorney, Agent, or Firm* — Fletcher Yoder PC

(57) ABSTRACT

Systems and methods for improving displayed image quality of an electronic display including a display pixel and a display driver are provided. A display pipeline receives input image data that indicates target luminance of the display pixel when displaying an image frame on the electronic display; determines a first bit group in pixel response corrected image data by mapping a first bit group in the input image data based at least in part on a first pixel response correction look-up-table; determines a second bit group in the pixel response corrected image data by mapping a second bit group in the input image data based at least in part on a second pixel response correction look-up-table; and outputs the pixel response corrected image data to the display driver to enable the display driver to facilitate displaying the image frame by writing the display pixel based on the pixel response corrected image data.

20 Claims, 9 Drawing Sheets

(56) References Cited

U.S. PATENT DOCUMENTS

| | | | | |
|---|---|---|---|---|
| 2008/0129762 | A1* | 6/2008 | Shiomi | G09G 3/3648 345/690 |
| 2009/0310015 | A1* | 12/2009 | El-Mahdy | G09G 5/02 348/441 |
| 2011/0050754 | A1 | 3/2011 | Hyun | |
| 2015/0302789 | A1* | 10/2015 | Furihata | G09G 3/2007 345/694 |
| 2016/0117971 | A1 | 4/2016 | Sacchetto et al. | |
| 2018/0075798 | A1* | 3/2018 | Nho | G09G 3/32 |

* cited by examiner

REDUCED FOOTPRINT PIXEL RESPONSE CORRECTION SYSTEMS AND METHODS

CROSS-REFERENCE TO RELATED APPLICATIONS

This application is a Non-Provisional Application claiming priority to U.S. Provisional Patent Application No. 62/398,698, entitled "REDUCED FOOTPRINT PIXEL RESPONSE CORRECTION SYSTEMS AND METHODS," filed Sep. 23, 2016, which is herein incorporated by reference in its entirety for all purposes.

BACKGROUND

The present disclosure relates generally to electronic displays and, more particularly, to pixel response correction in electronic displays.

This section is intended to introduce the reader to various aspects of art that may be related to various aspects of the present techniques, which are described and/or claimed below. This discussion is believed to be helpful in providing the reader with background information to facilitate a better understanding of the various aspects of the present disclosure. Accordingly, it should be understood that these statements are to be read in this light, and not as admissions of prior art.

Electronic devices often use one or more electronic displays to present visual representations of information as text, still images, and/or video by displaying one or more image frames. For example, such electronic devices may include computers, mobile phones, portable media devices, tablets, televisions, virtual-reality headsets, and vehicle dashboards, among many others. To display an image frame, an electronic display may control light emission (e.g., actual luminance) from its display pixels, for example, based on image data that indicates target (e.g., desired) luminance of the display pixels. In particular, the light emission from a display pixel may depend on magnitude of analog electrical (e.g., voltage and/or current) signals supplied (e.g., applied) to the display pixel.

However, in some instances, light emission response of display pixels in different electronic displays to an analog electrical signal may vary. As such, even when an analog electrical signal is supplied to a display pixel based on corresponding image data, the actual luminance of the display pixel may differ from its target luminance. When perceivable, this mismatch may result in visual artifacts that affect perceived image quality of a displayed image frame.

To reduce likelihood of perceivable visual artifacts, image data may be adjusted (e.g., corrected) based at least in part on expected response of display pixels in an electronic display. In some instances, the image data may be adjusted by processing the image data based at least in part on stored data indicative of the expected pixel response to determine pixel response corrected image data, which may then be used to display an image frame. As such, determining the pixel response corrected image data may affect data storage and/or data communication in an electronic device.

SUMMARY

A summary of certain embodiments disclosed herein is set forth below. It should be understood that these aspects are presented merely to provide the reader with a brief summary of these certain embodiments and that these aspects are not intended to limit the scope of this disclosure. Indeed, this disclosure may encompass a variety of aspects that may not be set forth below.

The present disclosure generally relates to improving displayed image quality of an electronic display by providing pixel response correction with improved data storage efficiency and/or data communication efficiency. In some embodiments, display pixels in different electronic displays may have varying light emission responses to supplied analog electrical signals, which may result in perceivable visual artifacts in displayed image frames. To facilitate reducing likelihood of producing perceivable visual artifacts, image data may be adjusted based at least in part on expected pixel response of display pixels in an electronic display, for example to determine pixel response corrected image data that compensates for variations in the expected pixel response from a target pixel response.

In some embodiments, pixel response corrected image data may be determined by mapping input image data based at least in part on a pixel response correction mapping. Since pixel response may be affected by various operational parameters, in some embodiments, multiple pixel response correction mappings each corresponding to a different set of expected operational parameters may be used. Additionally, in some embodiments, the pixel response correction mappings may be implemented using pixel response correction look-up-tables stored in an external storage device, such as controller memory. As such, in some embodiments, pixel response correction look-up-tables may be communicated (e.g., retrieved) from the external storage device.

To facilitate improving pixel response correction, the present disclosure provides techniques for improving data storage efficiency of the pixel response correction look-up-tables and/or data communication efficiency of the pixel response correction look-up-tables. In some embodiments, each pixel response correction mapping may be implemented using multiple pixel response correction look-up-tables. For example, a mapping may be implemented with a first (e.g., most-significant-bits (MSB)) look-up-table used to convert a first portion (e.g., bits 8-13) of the input image data to a corresponding first portion (e.g., bits 8-13) of the pixel response corrected image data and a second (e.g., least-significant-bits (LSB)) look-up-table used to convert a second portion (e.g., bits 0-7) of the input image data to a corresponding second portion (e.g., bits 0-7) of the pixel response corrected image data.

In some embodiments, the pixel response and, thus, the pixel response correction mappings used to determine pixel response corrected image data for different operational parameters sets may be relatively similar. As such, some pixel response correction mappings may be used to implement multiple different mappings. For example, the first mapping and a second mapping may implemented using the same first (e.g., MSB) look-up-table and different second (e.g., LSB) look-up-tables. In this manner, storage space used to store the pixel response correction look-up-tables for implementing multiple mappings may be reduced, thereby improving data storage efficiency.

Moreover, since portions of multiple mappings may be implemented using the same pixel response look-up-table, data communication to retrieve different mappings may be reduced. For example, when a first image frame is to be displayed based on the first mapping, a pixel response correction (PRC) block may store and use the corresponding first look-up-table and second look-up-table to determine the first pixel response corrected image data. Thus, when a second image frame is to be displayed directly after the first image frame using the second mapping, the pixel response correction block may merely retrieve the second look-up-table corresponding with the second mapping since the first mapping used to implement the second mapping is already stored, for example, in local storage of the pixel response correction block. In this manner, communication bandwidth and/or power consumption used to communicate (e.g., retrieve) stored pixel response correction look-up-tables may be reduced, thereby improving data communication efficiency.

BRIEF DESCRIPTION OF THE DRAWINGS

Various aspects of this disclosure may be better understood upon reading the following detailed description and upon reference to the drawings in which.

DETAILED DESCRIPTION

Figure 1:
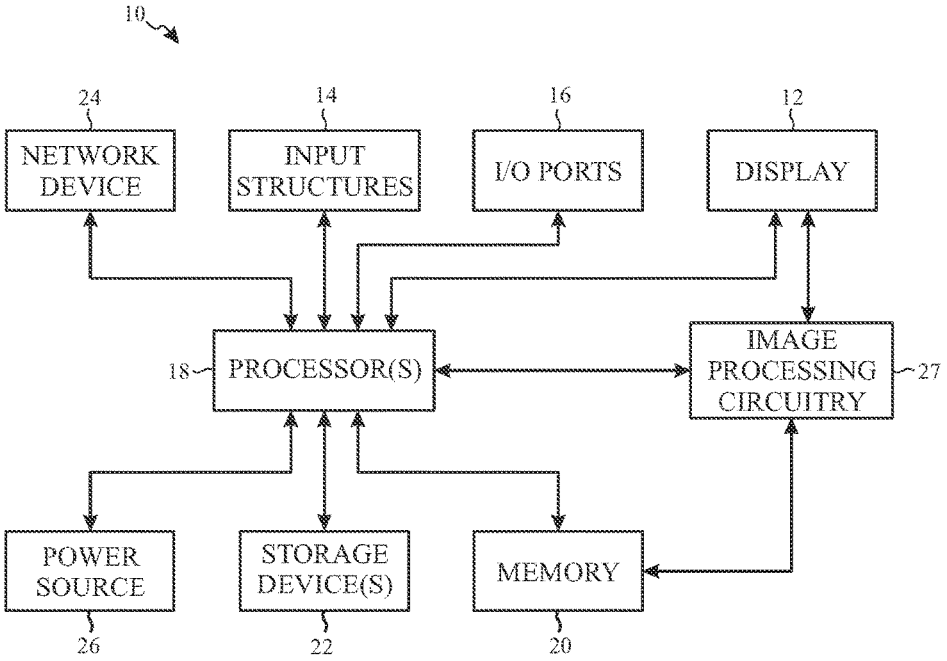
FIG. 1 is a block diagram of an electronic device used to display image frames, in accordance with an embodiment of the present disclosure.

One or more specific embodiments of the present disclosure will be described below. These described embodiments are only examples of the presently disclosed techniques. Additionally, in an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but may nevertheless be a routine undertaking of design, fabrication, and manufacture for those of ordinary skill having the benefit of this disclosure.

When introducing elements of various embodiments of the present disclosure, the articles "a," "an," and "the" are intended to mean that there are one or more of the elements. The terms "comprising," "including," and "having" are intended to be inclusive and mean that there may be additional elements other than the listed elements. Additionally, it should be understood that references to "one embodiment" or "an embodiment" of the present disclosure are not intended to be interpreted as excluding the existence of additional embodiments that also incorporate the recited features.

Generally, an electronic display may display an image frame by applying analog electrical signals (e.g., voltage and/or current) to display pixels on a display panel. In some electronic displays, the analog electrical signal supplied to a display pixel may be stored in the display pixel to control light emission and, thus, perceived (e.g., actual) luminance of the display pixel. For example, in a liquid crystal display (LCD), a voltage signal supplied to a display pixel may be stored in a pixel electrode to produce an electric field, which controls light emission from the display pixel by adjusting adjusts orientation of liquid crystals. Additionally, in an organic light-emitting diode (OLED) display, a voltage signal supplied to a display pixel may be stored in a storage capacitor, which controls control light emission from the display pixel by adjusting electrical power supplied to a self-emissive component.

However, even within the same type of electronic display, display pixels in different electronic displays may have varying light emission responses to supplied analog electrical signals. For example, supplying an analog electrical signal to a display pixel in one electronic display may result in one luminance while supplying the same analog electrical signal to a display pixel in another electronic display may result in a different luminance. In other words, pixel response of display pixel may affect actual luminance of the display pixels. In fact, in some instances, the pixel response may cause variation between the actual luminance and target luminance of the display pixels, which may be perceivable as a visual artifact in a display image frame.

To facilitate reducing likelihood of producing a perceivable visual artifact, image data may be adjusted (e.g., corrected) based at least in part on expected pixel response of display pixels in an electronic display. For example, a display pipeline may receive input (e.g., gamma domain) image data and output pixel response corrected image data that compensates for the expected pixel response. By displaying an image frame using the pixel response corrected image data, likelihood of perceivable visual artifacts in a displayed image frame may be reduced, thereby improving perceived image quality of the electronic display.

To determine the pixel response corrected image data, the display pipeline may utilize a mapping (e.g., relationship) indicative of the expected pixel response to map the input image data to the pixel response corrected image data. In some embodiments, the mappings may be predetermined and stored, for example, in a storage device (e.g., memory)

as one or more look-up-tables (LUTs). As such, to determine the pixel response corrected image data, the pixel response correction block may retrieve the stored mapping.

However, in some instances, pixel response of display pixels may be affected by various operational parameters, such as display duration of an image frame, refresh rate, environmental conditions (e.g., temperature), and/or charge accumulation caused by one or more previously displayed image frames. To help account for effect on pixel response, multiple mappings each corresponding to a different set of expected operational parameters may be used. For example, the pixel response correction block may use a first mapping to determine first pixel response corrected image data when expected temperature is 90° F. and expected refresh rate is 60 Hz. On the other hand, the pixel response correction block may use a second mapping to determine second pixel response corrected image data when expected temperature is 90° F. and expected refresh rate is 75 Hz.

Thus, in some embodiments, each of the multiple mappings may be predetermined and stored, for example, in memory. However, storing the multiple mappings may consume storage space, thereby limiting storage space available for performing other operations and/or resulting in use of a larger storage device (e.g., memory). Moreover, since operational parameters may change between image frames, different mappings may be used to determine the pixel response corrected image data for different image frames. However, retrieving stored mappings may consume electrical power and/or communication bandwidth. In fact, effects on storage space, power consumption, and/or communication bandwidth may increase as size (e.g., bit depth) of the image data and, thus, size of the mappings increase.

Accordingly, the present disclosure provides techniques for improving displayed image quality by providing pixel response correction, for example, with reduced storage space, reduced power consumption, and/or reduced communication bandwidth. To facilitate, in some embodiments, each pixel response correction mapping may be implemented using multiple pixel response correction look-up-tables. For example, a mapping may be implemented with a first (e.g., most-significant-bits (MSB)) look-up-table used to convert a first portion (e.g., bits 8-13) of the input image data to a corresponding first portion (e.g., bits 8-13) of the pixel response corrected image data and a second (e.g., least-significant-bits (LSB)) look-up-table used to convert a second portion (e.g., bits 0-7) of the input image data to a corresponding second portion (e.g., bits 0-7) of the pixel response corrected image data.

To facilitate using mappings implemented using multiple look-up-tables, input image data may be divided into bit groups each corresponding to one of the multiple look-up-tables. For example, when the mapping is implemented using the first look-up-table and the second look-up-table, bits of the input image data may be divided into the first portion (e.g., bit group) based on input size of the first look-up-table and into the second portion (e.g., bit group) based on input size of the second look-up-table. To help illustrate, when the input size of the first look-up-table is 6-bits and the input size of the second look-up-table is 8 bits, 14-bit input image data may be divided into a 6-bit group (e.g., bits 8-13) and into an 8-bit group (e.g., bits 0-7).

By processing each portion of the input image data using a corresponding pixel response correction look-up-table, corresponding portions of the pixel response corrected image data may be determined. For example, inputting the first portion of the input image data may result in the first look-up-table outputting a corresponding first portion (e.g., bit group) of the pixel response corrected image data and inputting the second portion of the input image data may result in the second look-up-table outputting a corresponding second portion (e.g., bit group) of the pixel response corrected image data. In particular, inputting the 6-bit group into the first look-up-table and the 8-bit group into the second look-up-table may result in determining a 6-bit group (e.g., bits 8-13) of the pixel response corrected image data and an 8-bit group (e.g., bits 0-7) of the pixel response corrected image data. In this manner, the pixel response corrected image data may be determined by concatenating the different portions of the pixel response corrected image data.

In some embodiments, the pixel response correction mappings used to determine pixel response corrected image data for different operational parameters sets may be relatively similar—particularly when the different operational parameters are relatively similar. For example, the first pixel response corrected image data determined using the first mapping (e.g., when the expected temperature is 90° F. and the expected refresh rate is 60 Hz) and the second pixel response corrected image data determined using the second mapping (e.g., when the expected temperature is 90° F. and the expected refresh rate is 75 Hz) may be relatively similar. In particular, less significant bits of the first pixel response corrected image data and the second pixel response corrected image data vary while more significant bits may be the same. For example, value of bits 8-13 (e.g., MSB group) in the first pixel response corrected image data and the second pixel response may be the same while value of bits 0-7 (e.g., LSB group) may be different.

As such, at least a portion of multiple pixel response correction mappings may be implemented using the same pixel response correction look-up-table. For example, the first mapping and the second mapping may implemented the same first (e.g., MSB) look-up-table and different second (e.g., LSB) look-up-tables. In this manner, storage space used to store the multiple mappings may be reduced. For example, when the image data is 14-bits, storing a 6-bit (e.g., first) look-up table and two 8-bit (e.g., second) look-up-tables may utilize less storage space compared to storing two 14-bit look-up-tables—particularly since the 6-bit look-up-table may be used to implement both the first mapping and the second mapping.

Moreover, since portions of multiple mappings may be implemented using the same pixel response look-up-table, data communication to retrieve different mappings may be reduced. For example, when a first image frame is to be displayed based on the first mapping, a pixel response correction (PRC) block may store and use the corresponding first look-up-table and second look-up-tables to determine the first pixel response corrected image data. Thus, when a second image frame is to be displayed directly after the first image frame using the second mapping, the pixel response correction block may merely retrieve the second look-up-table corresponding with the second mapping since the first mapping used to implement the second mapping already stored, for example, in local storage of the pixel response correction block. In this manner, communication bandwidth and/or power consumption used to communicate (e.g., retrieve) stored data may be reduced—particularly since operational parameters may gradually change over time, thereby resulting in mappings used with successive image frames to be relatively similar.

To help illustrate, an electronic device 10 including an electronic display 12 is shown in FIG. 1. As will be described in more detail below, the electronic device 10 may be any suitable electronic device, such as a computer, a mobile phone, a portable media device, a tablet, a television, a virtual-reality headset, a vehicle dashboard, and the like. Thus, it should be noted that FIG. 1 is merely one example of a particular implementation and is intended to illustrate the types of components that may be present in an electronic device 10.

In the depicted embodiment, the electronic device 10 includes the electronic display 12, one or more input devices 14, one or more input/output (I/O) ports 16, a processor core complex 18 having one or more processor(s) or processor cores, local memory 20, a main memory storage device 22, a network interface 24, a power source 26, and image processing circuitry 27. The various components described in FIG. 1 may include hardware elements (e.g., circuitry), software elements (e.g., a tangible, non-transitory computer-readable medium storing instructions), or a combination of both hardware and software elements. It should be noted that the various depicted components may be combined into fewer components or separated into additional components. For example, the local memory 20 and the main memory storage device 22 may be included in a single component. Additionally, the image processing circuitry 27 (e.g., a graphics processing unit) may be included in the processor core complex 18.

As depicted, the processor core complex 18 is operably coupled with local memory 20 and the main memory storage device 22. Thus, the processor core complex 18 may execute instruction stored in local memory 20 and/or the main memory storage device 22 to perform operations, such as generating and/or transmitting image data. As such, the processor core complex 18 may include one or more general purpose microprocessors, one or more application specific processors (ASICs), one or more field programmable logic arrays (FPGAs), or any combination thereof.

In addition to instructions, the local memory 20 and/or the main memory storage device 22 may store data to be processed by the processor core complex 18. Thus, in some embodiments, the local memory 20 and/or the main memory storage device 22 may include one or more tangible, non-transitory, computer-readable mediums. For example, the local memory 20 may include random access memory (RAM) and the main memory storage device 22 may include read only memory (ROM), rewritable non-volatile memory such as flash memory, hard drives, optical discs, and/or the like.

As depicted, the processor core complex 18 is also operably coupled with the network interface 24. In some embodiments, the network interface 24 may facilitate communicating data with another electronic device and/or a network. For example, the network interface 24 (e.g., a radio frequency system) may enable the electronic device 10 to communicatively couple to a personal area network (PAN), such as a Bluetooth network, a local area network (LAN), such as an 802.11x Wi-Fi network, and/or a wide area network (WAN), such as a 4G or LTE cellular network.

Additionally, as depicted, the processor core complex 18 is operably coupled to the power source 26. In some embodiments, the power source 26 may provide electrical power to one or more component in the electronic device 10, such as the processor core complex 18 and/or the electronic display 12. Thus, the power source 26 may include any suitable source of energy, such as a rechargeable lithium polymer (Li-poly) battery and/or an alternating current (AC) power converter.

Furthermore, as depicted, the processor core complex 18 is operably coupled with the one or more I/O ports 16. In some embodiments, an I/O ports 16 may enable the electronic device 10 to interface with other electronic devices. For example, when a portable storage device is connected, the I/O port 16 may enable the processor core complex 18 to communicate data with the portable storage device.

As depicted, the electronic device 10 is also operably coupled with the one or more input devices 14. In some embodiments, an input device 14 may facilitate user interaction with the electronic device 10, for example, by receiving user inputs. Thus, an input device 14 may include a button, a keyboard, a mouse, a trackpad, and/or the like. Additionally, in some embodiments, an input device 14 may include touch-sensing components in the electronic display 12. In such embodiments, the touch sensing components may receive user inputs by detecting occurrence and/or position of an object touching the surface of the electronic display 12.

In addition to enabling user inputs, the electronic display 12 may include a display panel with one or more display pixels. As described above, the electronic display 12 may control light emission from the display pixels to present visual representations of information, such as a graphical user interface (GUI) of an operating system, an application interface, a still image, or video content, by displaying image frames based at least in part on corresponding image data. As depicted, the electronic display 12 is operably coupled to the processor core complex 18 and the image processing circuitry 27. In this manner, the electronic display 12 may display image frames based at least in part on image data generated by the processor core complex 18, the image processing circuitry 27. Additionally or alternatively, the electronic display 12 may display image frames based at least in part on image data received via the network interface 24, an input device, and/or an I/O port 16.

Figure 2:
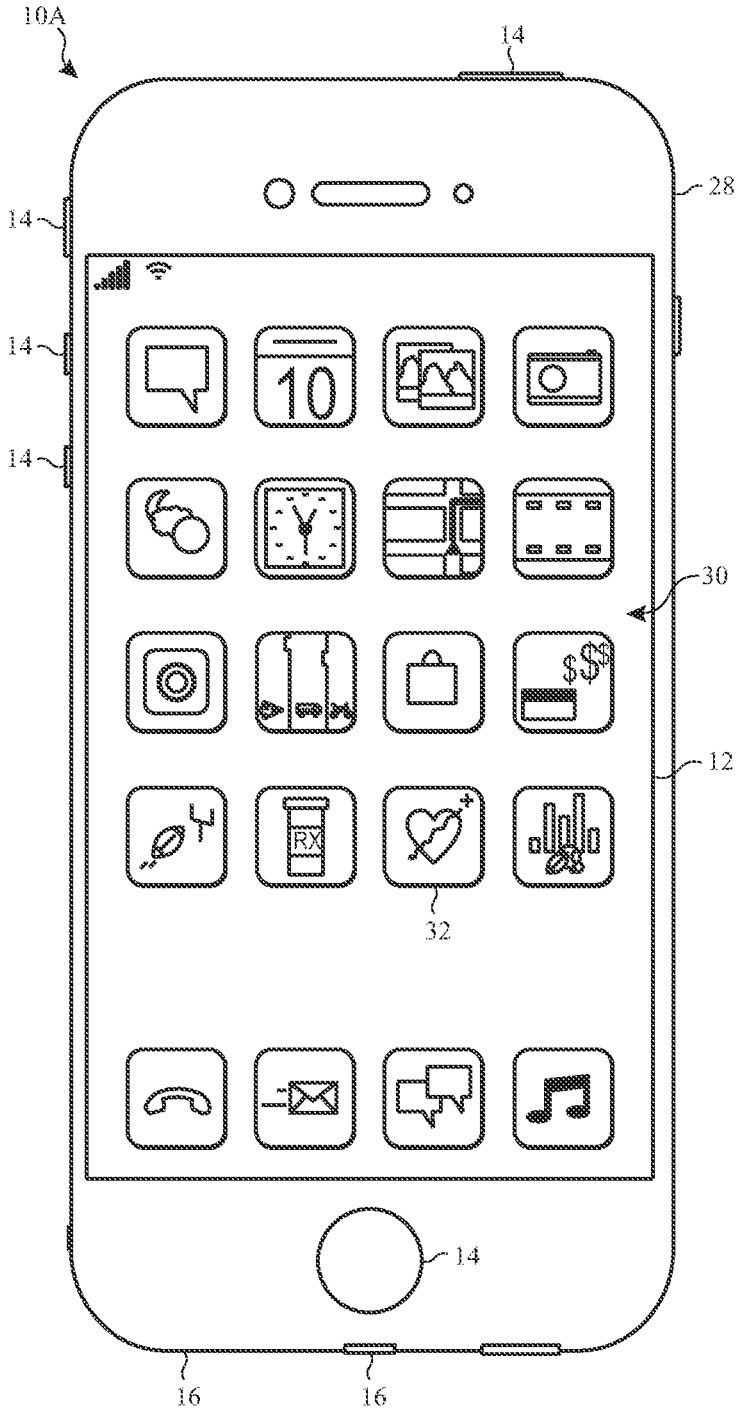
FIG. 2 is one example of the electronic device of FIG. 1, in accordance with an embodiment of the present disclosure.

As described above, the electronic device 10 may be any suitable electronic device. To help illustrate, one example of a suitable electronic device 10, specifically a handheld device 10A, is shown in FIG. 2. In some embodiments, the handheld device 10A may be a portable phone, a media player, a personal data organizer, a handheld game platform, and/or the like. For illustrative purposes, the handheld device 10A may be a smart phone, such as any iPhone® model available from Apple Inc.

As depicted, the handheld device 10A includes an enclosure 28 (e.g., housing). In some embodiments, the enclosure 28 may protect interior components from physical damage and/or shield them from electromagnetic interference. Additionally, as depicted, the enclosure 28 surrounds the electronic display 12. In the depicted embodiment, the electronic display 12 is displaying a graphical user interface (GUI) 30 having an array of icons 32. By way of example, when an icon 32 is selected either by an input device 14 or a touch-sensing component of the electronic display 12, an application program may launch.

Furthermore, as depicted, input devices 14 open through the enclosure 28. As described above, the input devices 14 may enable a user to interact with the handheld device 10A. For example, the input devices 14 may enable the user to activate or deactivate the handheld device 10A, navigate a user interface to a home screen, navigate a user interface to a user-configurable application screen, activate a voice-recognition feature, provide volume control, and/or toggle between vibrate and ring modes. As depicted, the I/O ports 16 also open through the enclosure 28. In some embodiments, the I/O ports 16 may include, for example, an audio jack to connect to external devices.

Figure 3:
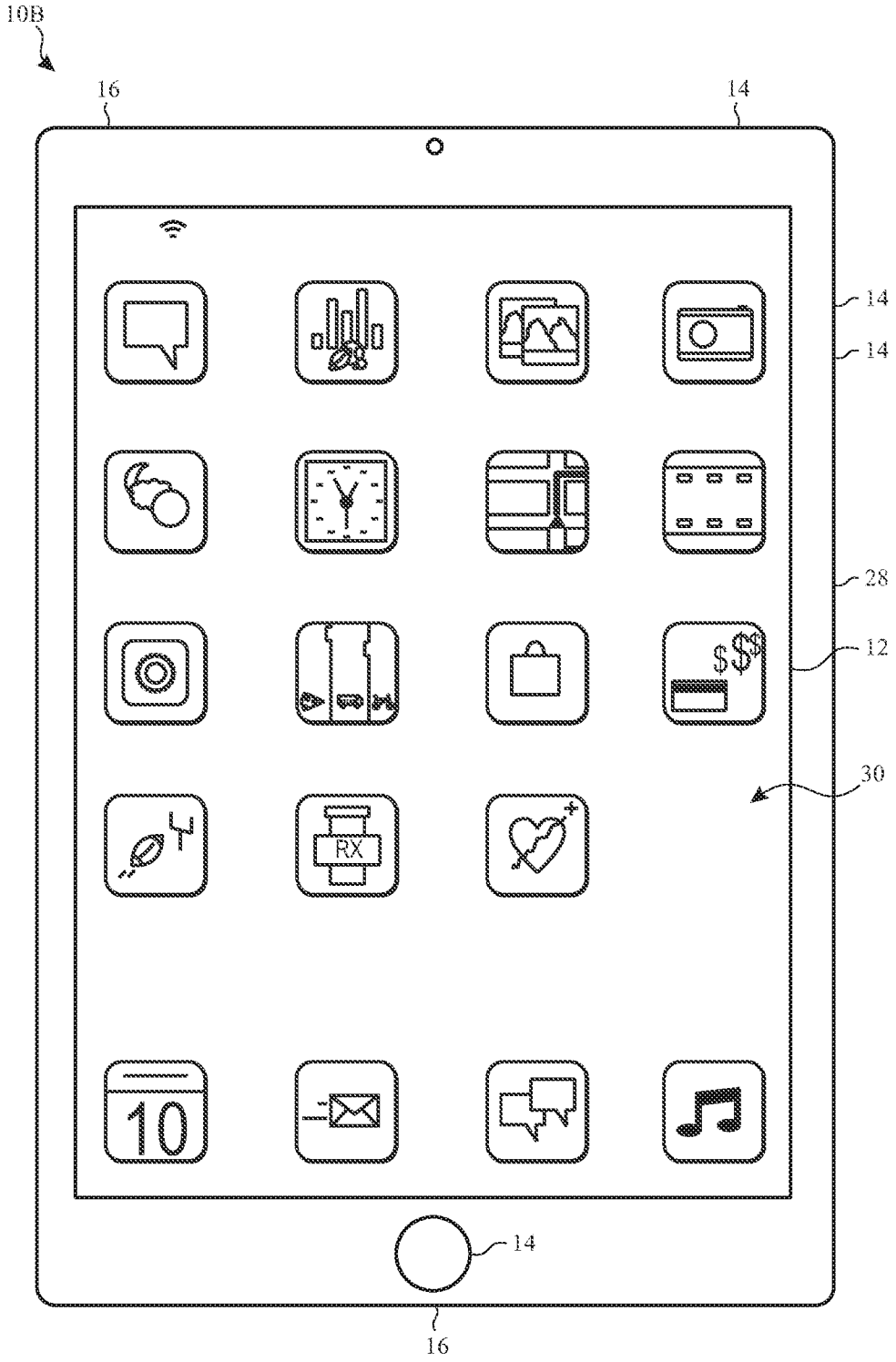
FIG. 3 is another example of the electronic device of FIG. 1, in accordance with an embodiment of the present disclosure.
Figure 4:
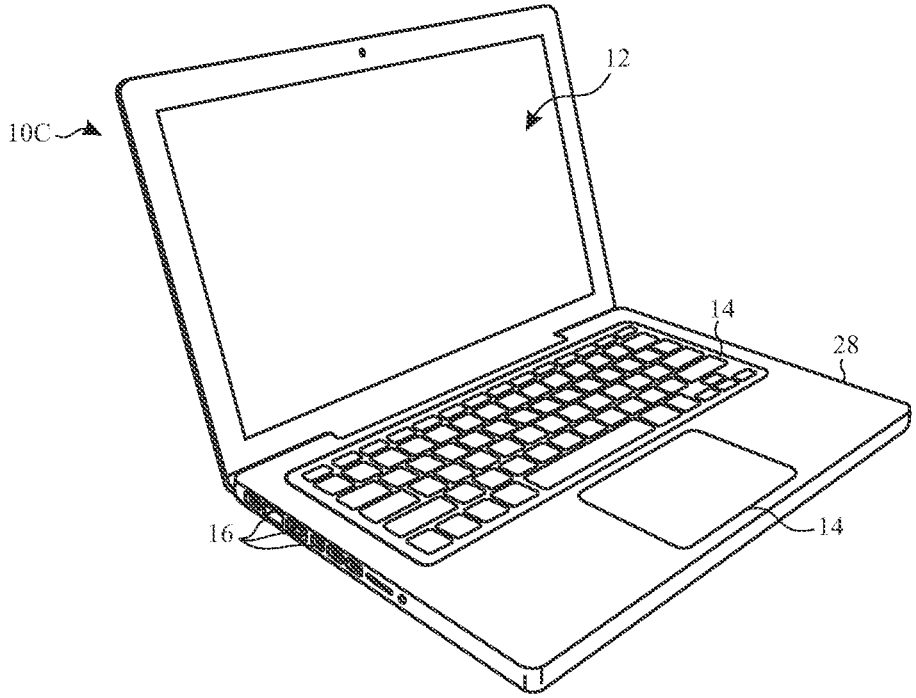
FIG. 4 is another example of the electronic device of FIG. 1, in accordance with an embodiment of the present disclosure.
Figure 5:
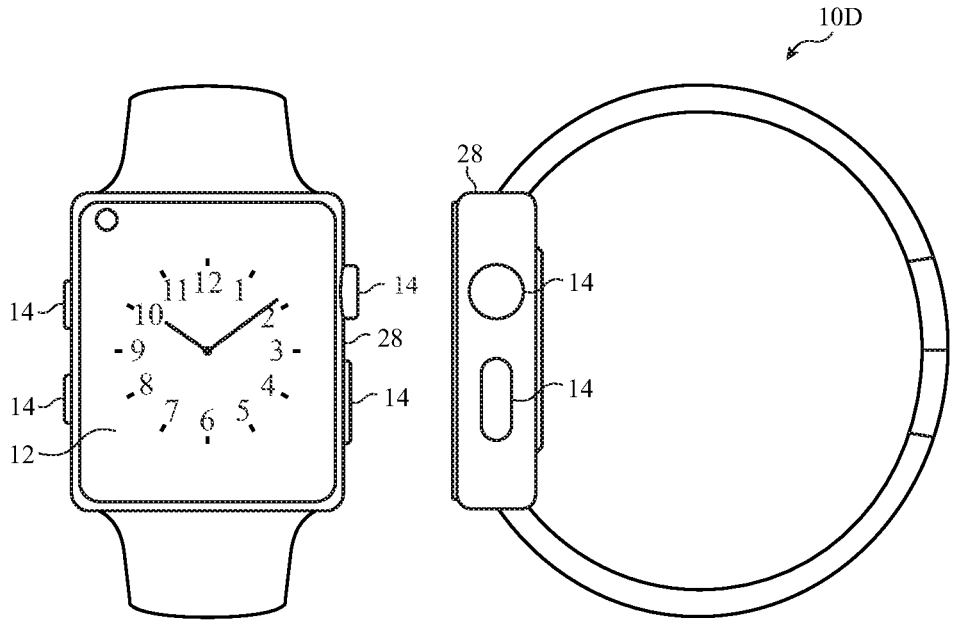
FIG. 5 is another example of the electronic device of FIG. 1, in accordance with an embodiment of the present disclosure.
Figure 6:
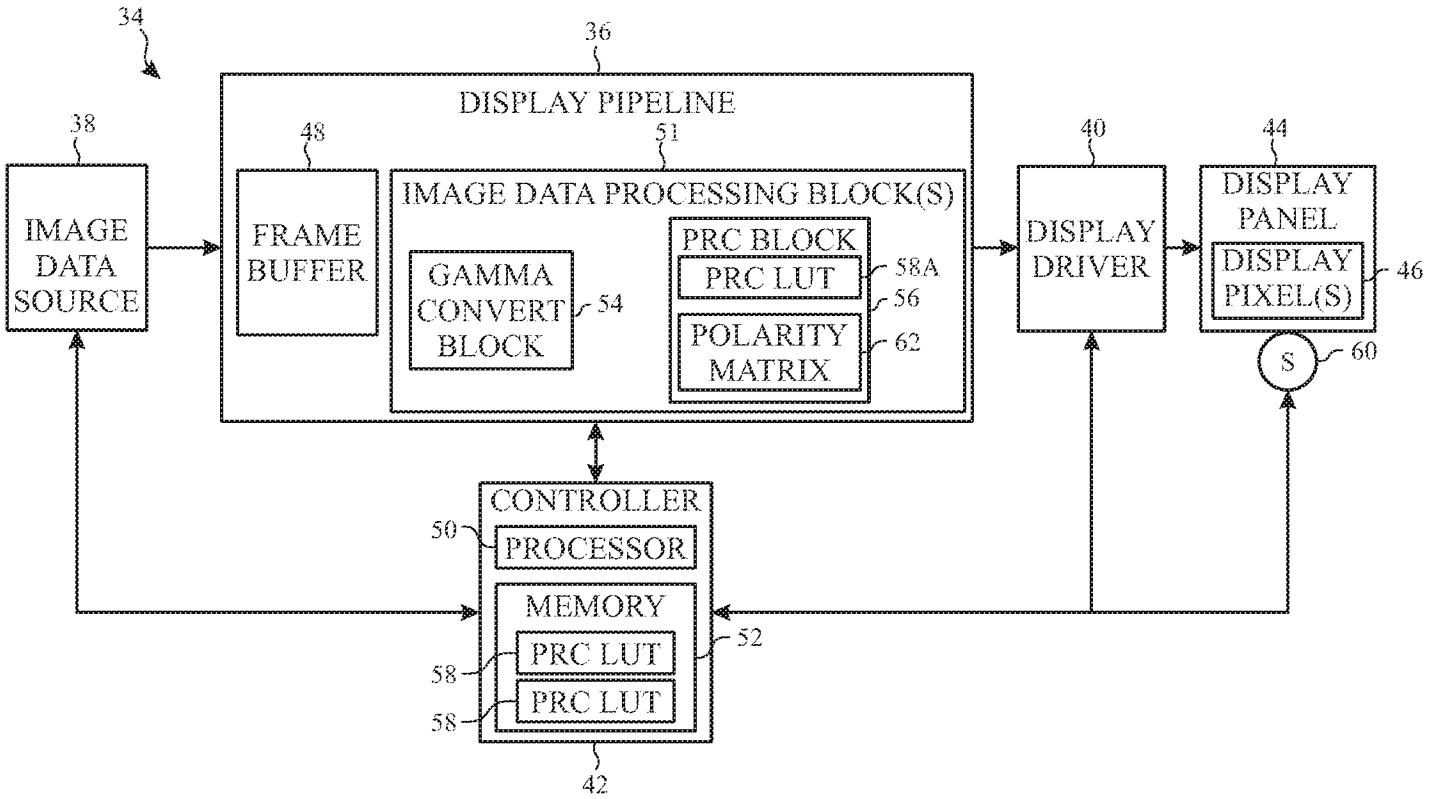
FIG. 6 is block diagram of a portion of the electronic device of FIG. 1 used to display image frames, in accordance with an embodiment of the present disclosure.

To further illustrate, another example of a suitable electronic device 10, specifically a tablet device 10B, is shown in FIG. 3. For illustrative purposes, the tablet device 10B may be any iPad® model available from Apple Inc. A further example of a suitable electronic device 10, specifically a computer 10C, is shown in FIG. 4. For illustrative purposes, the computer 10C may be any Macbook® or iMac® model available from Apple Inc. Another example of a suitable electronic device 10, specifically a watch 10D, is shown in FIG. 5. For illustrative purposes, the watch 10D may be any Apple Watch® model available from Apple Inc. As depicted, the tablet device 10B, the computer 10C, and the watch 10D each also includes an electronic display 12, input devices 14, I/O ports 16, and an enclosure 28.

As described above, the electronic display 12 may display image frames based on image data received, for example, from the processor core complex 18 and/or the image processing circuitry 27. In some embodiments, a display pipeline may analyze the image data, for example, to determine target luminance (e.g., grayscale level) of display pixels for displaying a corresponding image frame on the electronic display 12. Additionally, in some embodiments, the display pipeline may process the image data based at least in part on the analysis, for example, to determine pixel response corrected image data that compensates for expected pixel response of display pixels in the electronic display 12.

To help illustrate, a portion 34 of the electronic device 10 including a display pipeline 36 is shown in FIG. 5. In some embodiments, the display pipeline 36 may be implemented by in the electronic device 10, the electronic display 12, or a combination thereof. For example, the display pipeline 36 may be included in the processor core complex 18, the image processing circuitry 27, a timing controller (TCON) in the electronic display 12, other one or more processing units, other processing circuitry, or any combination thereof.

As depicted, the portion 34 of the electronic device 10 also includes an image data source 38, a display driver 40, a controller 42, and a display panel 44, which includes one or more display pixels 46. In some embodiments, the controller 42 may control operation of the display pipeline 36, the image data source 38, and/or the display driver 40. To facilitate controlling operation, the controller 42 may include a controller processor 50 and controller memory 52. In some embodiments, the controller processor 50 may execute instructions stored in the controller memory 52. Thus, in some embodiments, the controller processor 50 may be included in the processor core complex 18, the image processing circuitry 27, a timing controller in the electronic display 12, a separate processing unit, separate processing circuitry, or any combination thereof. Additionally, in some embodiments, the controller memory 52 may be included in the local memory 20, the main memory storage device 22, a separate tangible, non-transitory, computer readable medium, or any combination thereof.

In the depicted embodiment, the display pipeline 36 is communicatively coupled to the image data source 38. In this manner, the display pipeline 36 may receive image data from the image data source 38. As described above, in some embodiments, the image data source 38 may be included in the processor core complex 18, the image processing circuitry 27, or a combination thereof.

Additionally, in the depicted embodiment, the display pipeline 36 is communicatively coupled to the display driver 40. In this manner, the display driver 40 may receive image data from the display pipeline 36 and write image frames to the display panel 44 based at least in part on the received image data. To write an image frame, the display driver 40 may supply analog electrical (e.g., voltage or current) signals to the display pixels 46 on the display panel 44. In this manner, the display pixels 46 may control light emission based at least in part on received analog electrical signals to facilitate displaying the image frame on the electronic display 12.

To facilitate improving perceived image quality, the display pipeline 36 may analyze and/or process the image data before displaying a corresponding image frame. To facilitate analyzing and/or processing image data, the display pipeline 36 may include an image data buffer 48 used to store image data. In some embodiments, the image data buffer 48 may store image data received from the image data source 38, image data to be processed, image data already processed by the display pipeline 36, and/or image data to be supplied to the display driver 40. For example, the image data buffer 48 may store image data corresponding to one or more previous image frames, a current image frame, one or more subsequent image frames, or any combination thereof.

Additionally, the display pipeline 36 may include one or more image data processing blocks 51 that operate to analyze and/or process image data. For example, in the depicted embodiment, the image data processing blocks 51 include a gamma convert block 54 and a pixel response correction (PRC) block 56. Additionally, in some embodiments, the image data processing blocks 51 may include an ambient adaptive pixel (AAP) block, a dynamic pixel backlight (DPB) block, a white point correction (WPC) block, a sub-pixel layout compensation (SPLC) block, a burn-in compensation (BIC) block, a panel response correction (PRC) block, a dithering block, a sub-pixel uniformity compensation (SPUC) block, a content frame dependent duration (CDFD) block, an ambient light sensing (ALS) block, or any combination thereof.

As described above, the display pipeline 36 may receive image data from the image data source 38. In some embodiments, the image data received from the image data source 38 may indicate target luminance (e.g., grayscale level) of display pixels 46 for displaying an image frame in a linear domain. However, the human eye generally perceives luminance in a gamma (e.g., non-linear) domain. As such, to facilitate achieving target luminance, the gamma convert block 54 may convert linear domain image data into gamma domain image data. For example, the gamma convert block 54 may convert 8-bit or 10-bit linear domain image data into 14-bit gamma domain image data, which when used to display an image frame may facilitate reducing variation between perceived luminance and target luminance of the display pixels 46.

However, as described above, display pixels 46 in different electronic displays 12 and, thus, different display panels 44 may have varying light emission responses to supplied analog electrical signals. For example, varying pixel response may result in perceived luminance of display pixels 46 on one display panel 44 and perceived luminance of display pixel 46 on another display panel 44 differing even when the same analog electrical signals are supplied. In some instances, pixel response may result in actual luminance of display pixels 46 differing from their target luminance, which may be perceivable as visual artifacts on displayed image frames.

In some embodiments, pixel response of display pixels 46 on a display panel 44 may be affected by operational parameters, such as refresh rate, display duration, environmental conditions, polarity of supplied analog electrical signal, charge accumulation caused by one or more previously displayed image frames, and/or backlight luminance. Since pixel response may vary between different display panels 44 and/or based at least in part on operational parameters, in some embodiments, a calibration process may be performed on a display panel 44 to determine expected pixel response of display pixels 46 on the display panel 44. For example, the calibration process may include operating the display panel 44 with one or more operational parameter sets and determining difference between resulting actual luminance and target luminance of display pixels 46, which may be indicative of expected pixel response of the display pixels 46.

To facilitate improving perceived image quality, the pixel response correction block 56 may adjust image data to compensate for the expected pixel response of the display pixels 46. In particular, the pixel response correction block 56 may map input (e.g., gamma domain) image data into pixel response corrected image data, which accounts for the expected pixel response of the display pixels 46. To implement the mapping, in some embodiments, the pixel response correction block 56 may utilize one or more pixel response correction (PRC) look-up-tables (LUTs) 58.

In some embodiments, different pixel response correction look-up-tables 58 may correspond to different sets of expected operational parameters. For example, a first pixel response correction look-up-table 58 may be used to determine pixel response corrected image data to be written to a display pixel 46 for displaying an image frame when expected temperature of the display pixel 46 is 90° F., expected refresh rate of the display pixel 46 is 60 Hz, expected display duration of the image frame is 16.67 ms, and the pixel response corrected image data is expected to be written using a positive polarity analog electrical signal. Additionally, a second pixel response correction look-up-table 58 may be used to determine pixel response corrected image data to be written to a display pixel 46 for displaying an image frame when expected temperature of the display pixel 46 is 90° F., expected refresh rate of the display pixel 46 is 60 Hz, expected display duration of the image frame is 16.67 ms, and the pixel response corrected image data is expected to be written using a negative polarity analog electrical signal.

Since operational parameters may vary over a wide-range, a large number of pixel response correction mappings and, thus, pixel response correction look-up-tables 58 may be selected from to determine pixel response corrected image data that sufficiently accounts for variations in pixel response. In some embodiments, the mappings may be predetermined and stored in a tangible non-transitory computer-readable medium, for example, in local storage of the pixel response correction block 56. However, in some embodiments, storage capacity of local storage in the pixel response correction block 56 may be limited. Thus, to facilitate selectively implementing a large number of pixel response correction look-up-tables 58, the pixel response correction look-up-tables 58 may be stored in an external storage device, such as the controller memory 52.

As such, in some embodiments, one or more pixel response correction look-up-tables 58 may be selected and communicated to the pixel response correction block 56 based at least in part on expected operational parameters. For example, in the depicted embodiment, the controller memory 52 stores each pixel response correction look-up-table 58 that may potentially be used by the pixel response correction block 56. Additionally, one or more selected pixel response correction look-up-tables 58A may be selected and stored in local storage of the pixel response correction block 56 based at least in part on the expected operational parameters.

In some embodiments, the expected operational parameters may be determined via the frame buffer 48, one or more sensors 60, and/or the controller 42. For example, a temperature sensor 60 may determine sensor data indicative of temperature of the display panel 44. Additionally, the frame buffer 48 may store image data used to display previous image frames. Furthermore, since used to control operation of the electronic display 12, the controller 42 may determine expected refresh rate and/or expected display duration, for example, based at least in part on refresh rate and/or display duration of previous image frames.

Additionally, in some embodiments, the expected operational parameters may be determined based at least in part on a polarity matrix 62. In particular, the polarity matrix 62 may be used to determine polarity of analog electrical signals expected to be supplied by the display driver 40 to the display pixel 46. In some embodiments, the polarity matrix 62 may indicate polarity to be supplied to a subset (e.g., group or block) of the display pixels 46 based at least in part on inversion scheme implemented in the electronic display 12. Thus, as will be described in more detail below, expected polarity used to write a display pixel 46 may be determined by mapping the polarity matrix 62 over the display panel 44 and determining location of the display pixel 46 in the polarity matrix 62.

In this manner, the pixel response correction block 56 may determine pixel response corrected image data using one or more of the selected pixel response correction look-up-tables 58A. For example, when the input image data is 14-bit gamma domain image data, the pixel response correction block 56 may output 14-bit pixel response corrected image data, which accounts for expected pixel response of the display pixels 46. In this manner, the display pipeline 36 may enable the display driver 40 to write an image frame to the display pixels 46 based at least in part on the pixel response corrected image data, thereby reducing likelihood that variation in pixel response causes perceivable visual artifacts in the displayed image frame and, thus, improving perceived image quality.

Figure 7:
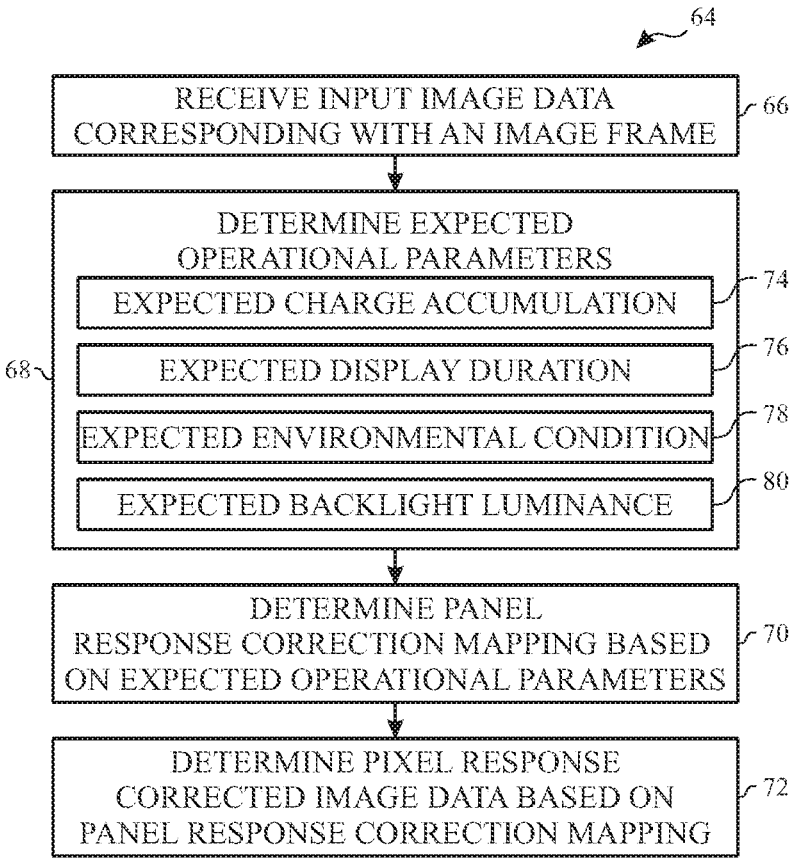
FIG. 7 is flow diagram of a process for operating the electronic device portion of FIG. 6, in accordance with an embodiment of the present disclosure.

To help illustrate, one embodiment of a process 64 for controlling operation of the display pipeline 36 is described in FIG. 7. Generally, the process 64 includes receiving input image data corresponding with an image frame (process block 66), determining expected operational parameters (process block 68), determining a panel response correction mapping based at least in part on the expected operational parameters (process block 70), and determining pixel response corrected image data based at least in part on the panel response correction mapping (process block 72). In some embodiments, the process 64 may be implemented based on circuit connections formed in the display pipeline 36. Additionally or alternatively, in some embodiments, the process 64 may be implemented by executing instructions stored in a tangible, non-transitory, computer-readable medium, such as the controller memory 52, using a processor, such as the controller processor 50.

Accordingly, in some embodiments, the controller 42 may instruct the image data source 38 to communicate image data corresponding with an image frame to the display pipeline 36 (process block 66). As described above, the display pipeline 36 may store the image data in the frame buffer 48. Additionally, as described above, the display pipeline 36 may analyze and/or process the image data using one or more image data processing blocks 51 to facilitate improving perceived image quality of the image frame when displayed. For example, the gamma convert block 54 may convert linear domain image data received from the image data source 38 into gamma domain image data. In some embodiments, the display pipeline 36 may then input the gamma domain image data to the pixel response correction block 56 for further processing.

Additionally, the controller 42 may determine operational parameters expected to be present when the image frame is to be displayed (process block 68). In particular, the controller 42 may determine an expected value of operational parameters that are expected to affect pixel response of display pixels 46. Thus, in some embodiments, determining the expected operational parameters may include determining expected charge accumulation caused by displaying one or more previous image frames (process block 74). As described above, in some embodiments, the frame buffer 48 may store image data corresponding to multiple image frames including image data (e.g., pixel response corrected image data) used to display previous image frames. Accordingly, in such embodiments, the controller 42 may retrieve image data corresponding with one or more previous image frames from the frame buffer 48. By analyzing the image data, the controller 42 may determine magnitude of analog electrical signals used to write one or more previous image frames and, thus, expected charge accumulation in the display pixels 46.

Additionally, in some embodiments, determining the expected operational parameters may include determining expected refresh rate and, thus, expected display duration of the image frame (process block 76). In some embodiments, refresh rate used to display image frames may be relatively constant (e.g., fixed), for example, when an electronic display 12 operates in an auto mode to display each image frame at a 60 Hz refresh rate. Accordingly, by determining the relatively constant refresh rate, the controller 42 may determine the expected refresh rate and, thus, expected display duration of the image frame. For example, when the electronic display is operating in the auto mode, the controller 42 may determine that the expected refresh rate is 60 Hz and the expected display duration of the image frame is 16.67 ms.

However, in some embodiments, refresh rate used to display image frames may be dynamically adjusted, for example, when an electronic display 12 operates in a normal mode. In some embodiments, when operation in the normal mode, an electronic display 12 may a refresh displayed image frame based at least in part on when image data corresponding with a successive image frame is received from the image data source 38. In other words, in some instances, the actual refresh rate and/or display duration of the image frame may be unable to be determined with certainty while corresponding image data is being processed by the display pipeline 36 and, more particularly, the pixel response correction block 56.

Since refresh rate may gradually change between successive image frames, in some embodiments, the controller 42 may determine the expected refresh rate of the image frame based at least in part on actual refresh rate used to display one or more previous image frames. For example, when the a directly previous is displayed using a 30 Hz refresh rate, the controller 42 may determine that the expected refresh rate of the image frame is 30 Hz and, thus, expected display duration of the image frame is 33.33 ms. Additionally, when a directly previous image frame is a residual image frame displayed using a 120 Hz refresh rate and an image frame directly before the residual image frame is displayed using a 45 Hz refresh rate, the controller 42 may determine that the expected refresh rate of the image frame is 45 Hz and, thus, expected display duration is 22.22 ms.

Furthermore, in some embodiments, determining the expected operational parameters may include determining environmental conditions expected to be present when the image frame is to be display (process block 78). In some embodiments, environmental conditions that may affect pixel response include temperature, humidity, and/or atmospheric pressure. Thus, the expected environmental conditions may include expected temperature of the display panel 44, expected humidity in the air surrounding the display panel 44, and/or expected atmospheric pressure applied on the display panel 44.

To facilitate determining the environmental conditions, in some embodiments, a sensing operation may be performed. In some embodiments, one or more sensors 60 may determine and communicate sensor data indicative of the environmental conditions to the controller 42. For example, sensor 60 may include a temperature sensor capable of measuring a temperature of the display panel 44 and communicate sensor data indicating the measured temperature to the controller 42. Additionally or alternatively, sensor 60 may include a current sensor 60 capable of measuring current output from one or more display pixels 46, which may indirectly indicate effect of environmental conditions on pixel response, and communicate sensor data indicating the measured current to the controller 42. In this manner, the controller 42 may determine the expected environmental conditions by analyzing received sensor data.

Moreover, in some embodiments, determining the expected operational parameters may include determining backlight luminance expected to be used for displaying the image frame (process block 80). In some embodiments, the controller 42 may control backlight luminance based at least in part on ambient light conditions. Thus, to determine expected backlight luminance, the controller 42 may determine ambient light conditions expected to be present when the image frame is to be displayed. In some embodiments, sensor 60 may also include an ambient light sensor 60 to measure ambient light around (e.g., in-front) the display panel 44 and communicate sensor data indicating the measured ambient light to the controller 42. In this manner, the controller 42 may determine the expected ambient light conditions and, thus, the expected backlight luminance by analyzing received sensor data.

Based at least in part on the techniques described above, the controller 42 may determine operational parameters expected to affect pixel response when the image frame is to be displayed, such as expected charge injection in the display pixels 46, expected display duration of the image frame, expected refresh rate used to display the image frame, expected temperature of the display panel 44, expected humidity surrounding the display panel 44, expected atmospheric pressure exerted on the display panel 44, expected ambient light conditions surrounding the display panel 44, and/or expected backlight luminance used to display the image frame. As should be appreciated, the described expected operational parameters are merely intended to be illustrative and not limiting. In particular, when other operational parameters are expected to affect pixel response, expected values of those operational parameters may additionally or alternatively be determined in any suitable manner.

Based at least in part on the expected operational parameters, a pixel response correction mapping may be determined (process block 70). As described above, since operational parameters may affect pixel response, the pixel response correction block 56 may use different pixel response mappings to convert input image data into pixel response corrected image data when different sets of operational parameters are expected to be present. Additionally, as described above, the pixel response correction mappings may be implemented using pixel response correction look-up-tables 58 predetermined and stored, for example, in local storage of the pixel response correction block 56 and/or in external storage, such as the controller memory 52.

Thus, in some embodiments, the controller 42 may select and communicate one or more pixel response correction look-up-tables 58 from the controller memory 52 to the pixel response correction block 56 based at least in part on the expected operational parameters. Additionally or alternatively, the pixel response correction block 56 may select and retrieve one or more pixel response correction look-up-tables 58 from the controller memory 52 based at least in part on the expected operational parameters. In any case, the pixel response correction block 56 may receive selected pixel response correction look-up-tables 58A from external storage, for example, via direct memory access (DMA) from the controller memory 52. Additionally, the pixel response correction block 56 may store one or more of the selected pixel response correction look-up-tables 58A in local storage.

When predetermined and stored, the pixel response correction look-up-tables 58 may consume storage space in the external storage. In fact, storage space consumed by storing pixel response correction look-up-tables 58 may increase as size (e.g., bit depth) of the input image data and/or the pixel response corrected image data increases. For example, storage space consumed to store a first pixel response correction look-up-table 58 used to convert 14-bit gamma domain image data into 14-bit pixel response corrected image data may be greater than storage space consumed to store a second pixel response correction look-up-table used to convert 8-bit gamma domain image data into 8-bit pixel response corrected image data. Moreover, storage space consumed by storing pixel response correction look-up-tables 58 may increase as number of pixel response correction mappings selected from increases. As described above, a large number of pixel response correction mappings may be selected from to sufficiently account for effects on pixel response, which may cause storage space consumed for storing the pixel response correction look-up-tables 58 to further increase.

However, storage space consumed for storing the pixel response correction look-up-tables 58 may reduce storage space available to store other data. In some instances, this may result in increasing total storage space, for example, by utilizing a controller memory 52 with larger storage capacity. However, increasing storage space may also increase implementation associated cost, such as component count, component size, packaging size, power consumption, and/or the like.

To facilitate improving storage efficiency, in some embodiments, each pixel response correction mapping may be implemented using multiple pixel response correction look-up-tables 58. For example, a first pixel response correction mapping selected when a first operational parameter set is expected to be present may be implemented with a first look-up-table used to convert a first portion of input image data to a corresponding first portion of pixel response corrected image data and a second look-up-table used to convert a second portion of the input image data to a corresponding second portion of the pixel response corrected image data. Thus, to determine a pixel response correction mapping, the pixel response correction block 56 may determine each of the pixel response correction look-up-tables used to implement the mapping.

Figure 8:
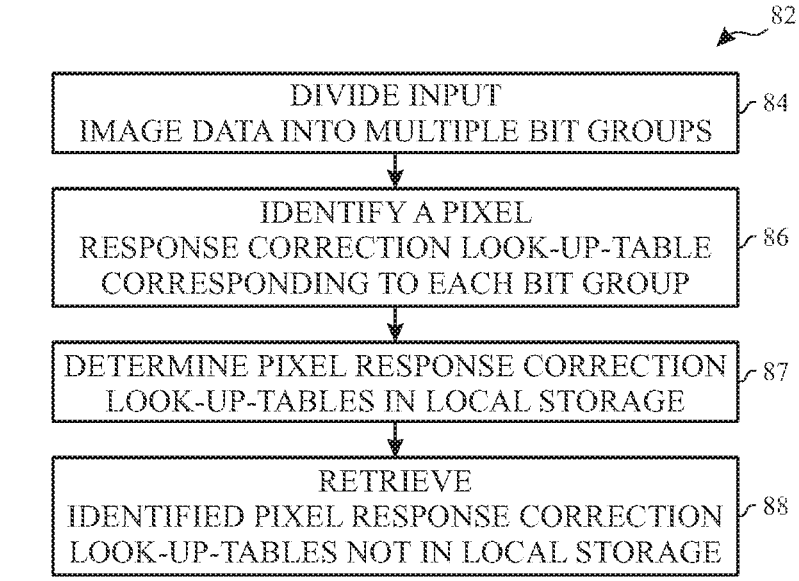
FIG. 8 is a flow diagram of a process for determining pixel response correction look-up-tables, in accordance with an embodiment of the present disclosure.

To help illustrate, one embodiment of a process 82 for determining a pixel response correction mapping is described in FIG. 8. Generally, the process 82 includes dividing input image data into multiple bit groups (process block 84), identifying a pixel response correction look-up-table corresponding to each bit group (process block 86), determining pixel response correction look-up-tables in local storage (process block 87), and retrieving identified pixel response look-up-tables not in local storage (process block 88). In some embodiments, the process 82 may be implemented based on circuit connections formed in the display pipeline 36. Additionally or alternatively, in some embodiments, the process 82 may be implemented by executing instructions stored in a tangible, non-transitory, computer-readable medium, such as the controller memory 52, using a processor, such as the controller processor 50.

Accordingly, in some embodiments, the controller 42 may instruct the pixel response correction block 56 to divide input image data into multiple bit groups (process block 84). In some embodiments, the pixel response correction block 56 may divide the input image data into two bit groups—namely a most-significant-bit (MSB) group and a least-significant-bit (LSB) group. For example, when the input image data is 14-bit gamma domain image data, the pixel response correction block 56 may separate bits 8-13 into the MSB group and bits 0-7 into the LSB group. As should be appreciated, the pixel response correction block 56 may divide the input image data into any suitable number of bit groups each including any suitable number of bits. For example, in other embodiments, the pixel response correction block 56 may divide input into three or more bit groups.

Additionally, the controller 42 may instruct the pixel response correction block 56 to identify (e.g., select) a pixel response correction look-up-table 58 corresponding with each bit group (process block 65). For example, when the input image data is divided between a MSB group and an LSB group, the pixel response correction block 56 may identify a MSB pixel response correction look-up-table 58 to be used to map the MSB group and a LSB pixel response correction look-up-table 58 to be used to map the LSB group based at least in part on the expected operational parameters. As described above, pixel response correction look-up-tables 58 may be stored in external storage, such as the controller memory 52, and selected pixel response correction look-up-tables 58A may be stored in local storage of the pixel response correction block 56.

Thus, the controller 42 may instruct the pixel response correction block 56 to determine whether the identified pixel response correction look-up-tables 58 are currently stored in local storage (process block 87). In some embodiments, the pixel response correction block 56 may poll the local storage to determine the selected pixel response correction look-up-tables 58A currently stored in the local storage. In this manner, the pixel response correction block 56 may determine which of the identified pixel response correction look-up-tables 58 are not currently stored in the local storage.

The controller 42 may also instruct the pixel response correction block 56 to retrieve the identified pixel response correction look-up-tables 58 not currently stored in the local storage (process block 88). As described above, pixel response correction look-up-tables 58 may be stored in external storage, such as controller memory 52. Additionally, as described above, a pixel response correction mapping may be implemented using multiple pixel response correction look-up-tables 58, which may facilitate improving storage and/or data communication efficiency.

Figure 9:
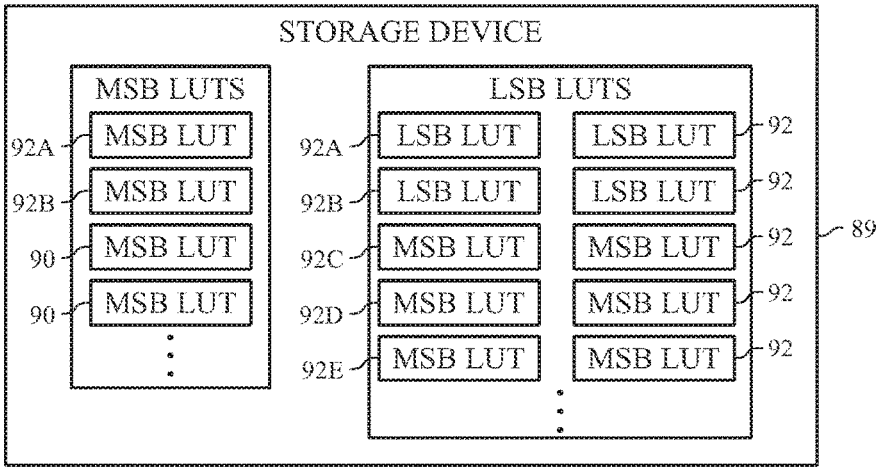
FIG. 9 is a block diagram of pixel response correction look-up-tables stored in memory, in accordance with an embodiment of the present disclosure.

To help illustrate, an example of a storage device 89 storing multiple pixel response correction look-up-tables 58 used to implement mappings corresponding to different operational parameters sets is shown in FIG. 9. In the depicted embodiment, the pixel response correction look-up-tables 58 include multiple MSB look-up-tables 90 and multiple LSB look-up-tables 92. In particular, each mapping may be implemented using one MSB look-up-table 90 and one LSB look-up-table 92. For example, a first pixel response correction mapping may be implemented using a first MSB look-up-table 90A and a first LSB look-up-table 92A.

Although different, in some instances, expected pixel response when different operational parameter sets are present may be relatively similar—particularly when the different operational parameter sets are relatively similar. For example, a first expected pixel response when temperature is 90° F. and the refresh rate is 60 Hz may be relatively similar to a second expected pixel response when temperature is 90° F. and the refresh rate is 75 Hz. As such, a first mapping used to account for the first expected pixel response and a second mapping used to account for the second expected pixel response may be relatively similar.

In particular, likelihood of bits in pixel response corrected image data determined using different mappings differing may increase moving from the most-significant-bit to the least-significant-bit. Thus, for example, an MSB group of first pixel response corrected image data determined using the first mapping may be the same as an MSB group of second pixel response corrected image data determined using the second mapping. However, an LSB group of the first pixel response corrected image data may vary from an LSB group of the second pixel response corrected image data.

As such, in some instances, different mappings may be implemented at least in part using the same pixel response correction look-up-table 58. For example, when the first pixel response mapping is implemented using the first MSB look-up-table 90A and the first LSB look-up-table 92A, the second pixel response mapping may be implemented using also using the first MSB look-up-table 90A, but with a second LSB look-up-table 92B. In this manner, storage efficiency of the storage device 89 may be improved. For example, instead of storing a first 14-bit look-up-table used to implement the first mapping and a second 14-bit look-up-table used to implement the second mapping, the storage device 89 may store the first 6-bit MSB look-up-table 90A, the first 8-bit LSB look-up-table 92A, and the second 8-bit LSB look-up-table 92B, which comparatively may consume less storage space in the storage device 89.

In a similar manner, other mappings may be implemented using shared MSB look-up-tables 90 and/or shared LSB look-up-tables 92. For example, when relatively similar, a third mapping may be implemented using a second MSB look-up-table 90B and a third LSB look-up-table 92C, a fourth mapping may be implemented using the second MSB look-up-table 90B and a fourth LSB look-up-table 92D, and a fifth mapping may be implemented using the second MSB look-up-table 90B and a fifth LSB look-up-table 92E. However, when a mapping is not relatively similar with other mappings, the mapping may be implemented using a unique (e.g. non-shared) MSB look-up-table 90 and a unique (e.g., non-shared) LSB look-up-table 92.

As described above, retrieving (e.g., communicating) pixel response correction look-up-tables from the storage device 89 may consume communication bandwidth and/or electrical power. By sharing pixel response correction look-up-tables 58 between different mappings, retrieval of pixel response correction look-up-tables 58 from the storage device 89 may be reduced. In particular, operational parameters present may gradually change between successive image frames. For example, one image frame may be displayed at a refresh rate of 60 Hz and a next successive image frame may be display at a refresh rate of 75 Hz.

As such, the mappings used to determine pixel response corrected image data for displaying successive image frames may be relatively similar. For example, to display the first image frame when the first operational parameter set is expected to be present, the pixel response correction block 56 may store the first MSB look-up-table 90A and the first LSB look-up-table 92A in local storage. Using the first MSB look-up-table 90A and the first LSB look-up-table 92A, the pixel response correction block 56 may determine first pixel response corrected image data used to display the first image frame.

To display the second image frame when the second operational parameter set is expected to be present, the pixel response correction block 56 may identify that the first MSB look-up-table 90A and the second LSB look-up-table 90B are to be used to determine second pixel response corrected image data. As such, the pixel response correction block 56 may retrieve and store the second LSB look-up-table 90B. On the other hand, since already be stored in the local storage, retrieval of the first MSB look-up-table 90A may be obviated. In this manner, implementing each pixel response mapping using multiple pixel response correction look-up-tables 58, in addition to improving storage efficiency, may facilitate improving communication efficiency by reducing communication (e.g., retrieval) of the pixel response correct look-up-tables 58 and, thus, resulting consumption of communication bandwidth and/or electrical power.

As described, in some embodiments, pixel response of display pixels 46 may vary based at least in part on polarity of analog electrical signals used to write the display pixels 46. As such, to help account for variations in pixel response, the pixel response corrected image data determined by the pixel response correction block 56 may be different when the pixel response corrected image data is to be written using a positive polarity analog electrical signal compared to when the pixel response corrected image data is to be written using a negative polarity analog electrical signal.

In some embodiments, to facilitate accounting for differences in pixel response caused by polarity, the pixel response correction look-up-tables 58 may include positive pixel response correction look-up-tables 58 and negative pixel response correction look-up-tables 58. In particular, the positive pixel response correction look-up-tables 58 may be used to determine pixel response corrected image data corresponding to display pixels 46 expected to be written using positive polarity analog electrical signals. On the other hand, the negative pixel response correction-look-up tables 58 may be used to determine pixel response corrected image data corresponding to display pixels 46 expected to be written using negative polarity analog electrical signals.

Moreover, in some embodiments, the electronic display 12 may employ inversion schemes resulting displaying an image frame by writing some display pixels 46 using positive polarity analog electrical signals and other display pixels 46 using negative polarity analog electrical signals. For example, when implementing row inversion, display pixels 46 in odd numbered rows may be written using positive polarity analog electrical signals while display pixels 46 in even numbered rows are written using negative polarity analog electrical signals. Additionally, when implementing dot inversion, each display pixel 46 may be written using an analog electrical signal with opposite polarity compared to a top neighbor display pixel 46, a left neighbor display pixel 46, a right neighbor display pixel 46, and/or a bottom neighbor display pixel 46.

Since polarity may alternate relatively frequently, in some embodiments, the pixel response correction block 56 may store both the positive pixel response correction look-up-table 58 and the negative pixel response correction look-up-table 58 corresponding to an expected operational parameter in the local storage to facilitate improving communication efficiency. For example, the pixel response correction block 56 may store both the positive MSB look-up-table 90 and the negative MSB look-up-table 90 corresponding with the expected operational parameter set. Additionally or alternatively, the pixel response correction block 56 may store both the positive LSB look-up-table 92 and the negative LSB look-up-table 92 corresponding with the expected operational parameter set.

As described above, the input image data may be divided and converted as two bit groups (e.g., MSB group and LSB group. In other embodiments, input image data may be converted using any number of bit groups. For example, in some embodiments, the input image data may be converted as a single bit group. On the other hand, in other embodiments, the input image data may be converted as three or more bit groups. Thus, to facilitate implementing the pixel response correction look-up-tables 58, number and/or size of bit groups used convert the input image data may be determined.

Figure 10:
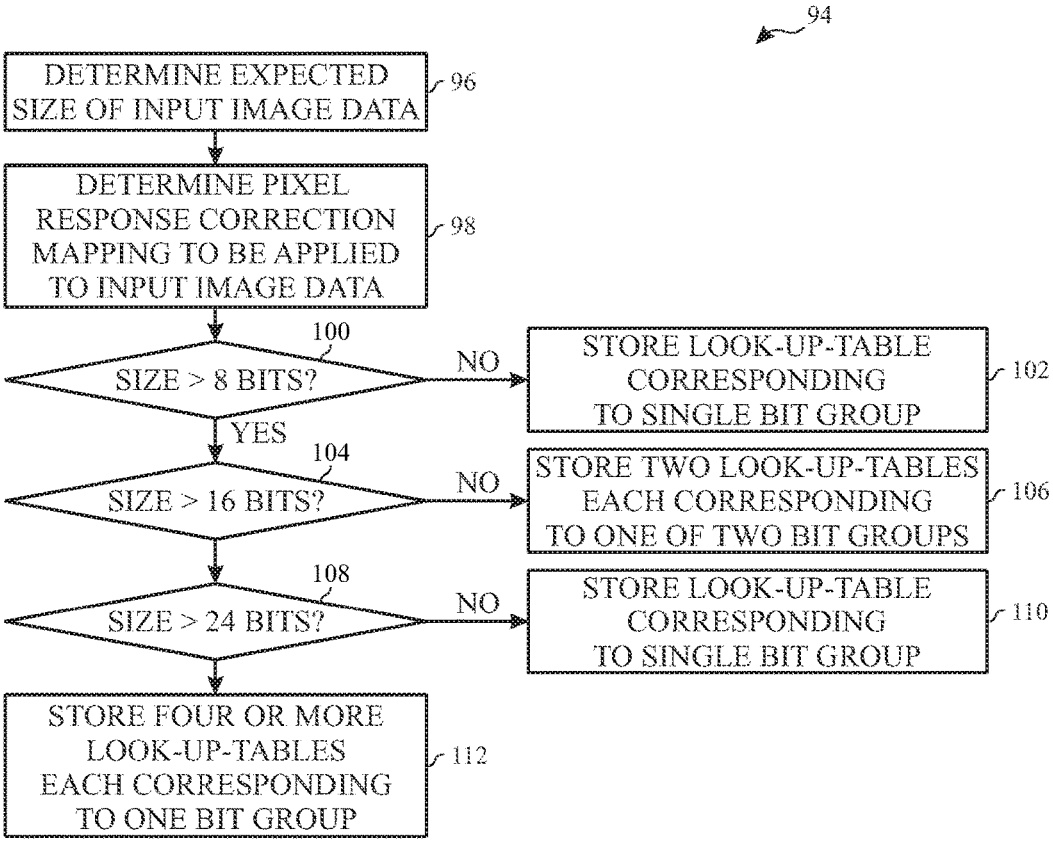
FIG. 10 is a flow diagram of a process for storing pixel response correction look-up-tables, in accordance with an embodiment of the present disclosure.

To help illustrate, one embodiment of a process 94 for implementing a pixel response correction mapping using one or more pixel response correction look-up-tables 58 is described in FIG. 10. Generally, the process 94 includes determining expected size of input image data (process block 96), determining a pixel response correction mapping to be applied to the input image data (process block 98), determining whether the size is greater than eight bits (decision block 100), storing one pixel response correction look-up-table corresponding to one bit group when size is not greater than eight bits (process block 102). When size is greater than eight bits, the process 94 includes determining whether the size is greater than sixteen bits (decision block 104) and storing two pixel response correction look-up-tables each corresponding to one of two bit groups when size is not greater than sixteen bits (process block 106). When size is greater than size is greater than sixteen bits, the process 94 includes determining whether size is greater than twenty-four bits (decision block 108), storing three pixel response correction look-up-tables each corresponding to one of three bit groups when size is not greater than twenty-four bits (process block 110), and storing four or more pixel response correction look-up-tables each corresponding to one bit group when size is greater than twenty-four bits (process block 112). In some embodiments, the process 94 may be implemented by executing instructions stored in a tangible, non-transitory, computer-readable medium, such as the controller memory 52, using one or more processors, such as the controller processor 50.

Accordingly, in some embodiments, the controller 42 may determine expected size (e.g., bit depth) of input image data to the pixel response correction block 56 (process block 96). For example, when 14-bit gamma domain image data is expected to be input to the pixel response correction block 56, the controller 42 may determine that the expected size is fourteen bits. Additionally, the controller 42 may determine a pixel response correction mapping to be applied to the input image data (process block 98). As describe above, in some embodiments, the controller 42 may perform a calibration process to determine the expected pixel response and determine the pixel response correction mapping based at least in part on the expected pixel response.

Additionally, the controller 42 may determine whether the expected size of the input image data is greater than eight bits (decision block 100). When the expected size is not greater than eight bits, the controller 42 may implement the pixel response mapping using one pixel response correction look-up-table 58, which corresponds to one bit group (process block 102). As such, when the display pipeline 36 is processing the input image data, the controller 42 may instruct the pixel response correction block 56 to convert the input image data as one bit group using the pixel response correction look-up-table 58.

When greater than eight bits, the controller 42 may determine whether the expected size of the input image data is greater than sixteen bits (decision block 104). When the expected size is not greater than sixteen bits, the controller 42 may implement the pixel response mapping using two pixel response correction look-up-tables 58, which each corresponds to one of two bit groups (process block 106). As such, when the display pipeline 36 is processing the input image data, the controller 42 may instruct the pixel response correction block 56 to convert the input image data using two bit groups each using one of the two pixel response correction look-up-tables 58.

When greater than sixteen bits, the controller 42 may determine whether the expected size of the input image data is greater than twenty-four bits (decision block 108). When the expected size is not greater than twenty-four bits, the controller 42 may implement the pixel response mapping using three pixel response correction look-up-tables 58, which each corresponds to one of three bit groups (process block 110). As such, when the display pipeline 36 is processing the input image data, the controller 42 may instruct the pixel response correction block 56 to convert the input image data using three bit groups each using one of the three pixel response correction look-up-tables 58.

On the other hand, when greater the expected size is greater than twenty-four bits, the controller 42 may implement the pixel response mapping using four or more pixel response correction look-up-tables 58, which each corresponds to one bit group (process block 112). Utilizing the process 94, in some embodiments, the pixel response mapping may be implemented using pixel response correction look-up-tables 58 each less than or equal to eight bits (e.g., one byte). In this manner, overhead for communicating (e.g., retrieving) the pixel response correction look-up-tables 58 to the pixel response correction block 56 may be reduced, thereby facilitating improved data communication efficiency.

Returning to the process 64 of FIG. 7, the controller 42 may instruct the pixel response correction block 56 to determine pixel response corrected image data based at least in part the selected pixel response correction mapping (process block 72). As described above, the pixel response correction block 56 may determine the pixel response corrected image data by implementing the pixel response correction mapping using pixel response correction look-up-tables 58A stored in local storage. For example, the pixel response correction block 56 may use one selected pixel response correction look-up-table 58A to convert each bit group in the input image data into a corresponding bit group of the pixel response corrected image data.

Figure 11:
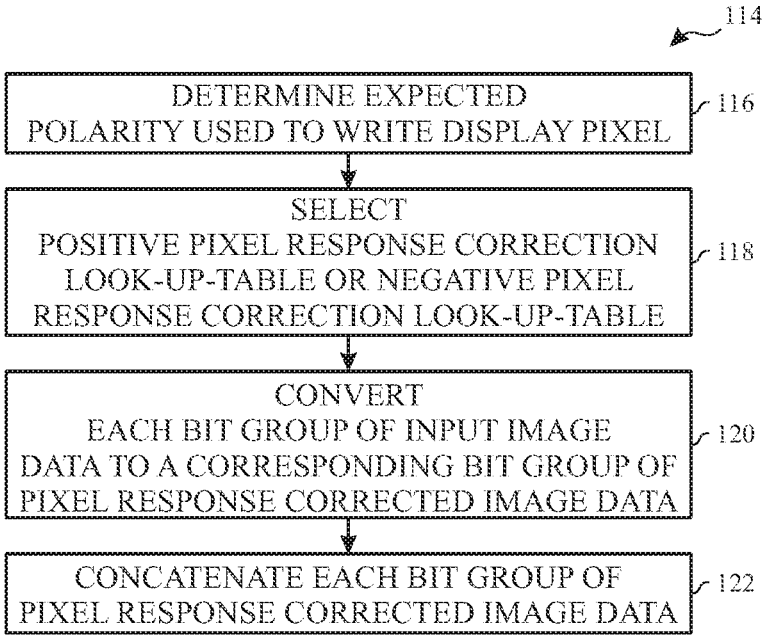
FIG. 11 is a flow diagram of a process for determining pixel response corrected image data, in accordance with an embodiment of the present disclosure.

To help illustrate, one embodiment of a process 114 for determining pixel response corrected image data is described in FIG. 11. Generally, the process 114 includes determining expected polarity used to write a display pixel (process block 116), selecting a positive pixel response correction look-up-table or a negative pixel response correction look-up-table (process block 118), converting each bit group of input image data to a corresponding bit group of pixel response corrected image data (process block 120), and concatenating each bit group of the pixel response corrected image data (process block 122). In some embodiments, the process 114 may be implemented based on circuit connections formed in the display pipeline 36. Additionally or alternatively, in some embodiments, the process 114 may be implemented by executing instructions stored in a tangible, non-transitory, computer-readable medium, such as the controller memory 52, using a processor, such as the controller processor 50.

Accordingly, in some embodiments, the controller 42 may instruct the pixel response correction block 56 to determine expected polarity of an analog electrical signal to be used to write a display pixel 46 (process block 116). In some embodiments, the controller 42 may keep track the expected polarity of each individual display pixel 46. However, keeping track on an individual display pixel 46 basis may increase storage space consumption—particularly as number of display pixels 46 on display panels 44 increases. To facilitate reducing storage space utilized to determine expected polarity, in some embodiments, the pixel response correction block 56 may use the polarity matrix 62. As described above, the polarity matrix 62 may indicate expected polarity of a group (e.g., block) of display pixels location, which may be mapped over the display panel 44 to facilitate determining expected polarity of the display pixel 46.

Figure 12:
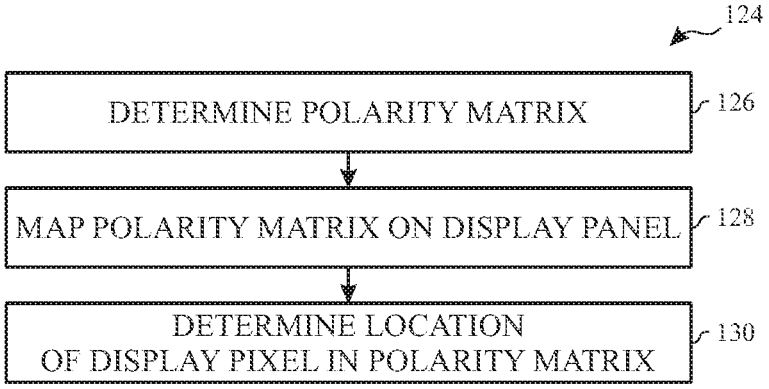
FIG. 12 is a flow diagram of a process for determining expected polarity of a display pixel, in accordance with an embodiment of the present disclosure.

To help illustrate, one embodiment of a process 124 for determining expected polarity of a display pixel 46 is described in FIG. 12. Generally, the process 124 includes determining a polarity matrix (process block 126), mapping the polarity matrix on a display panel (process block 128), and determining location of a display pixel in the polarity matrix (process block 130). In some embodiments, the process 124 may be implemented based on circuit connections formed in the display pipeline 36. Additionally or alternatively, in some embodiments, the process 124 may be implemented by executing instructions stored in a tangible, non-transitory, computer-readable medium, such as the controller memory 52, using a processor, such as the controller processor 50.

Accordingly, in some embodiments, the controller 42 may instruct the pixel response correction block 56 to determine the polarity matrix 62 (process block 126). In some embodiments, the polarity matrix 62 may be stored in local storage of the pixel response correction block 56 and/or the controller memory 52. Additionally, as described above, the polarity matrix 62 may indicate polarity a group of display pixel locations based at least in part on inversion scheme to be employed.

Figure 13:
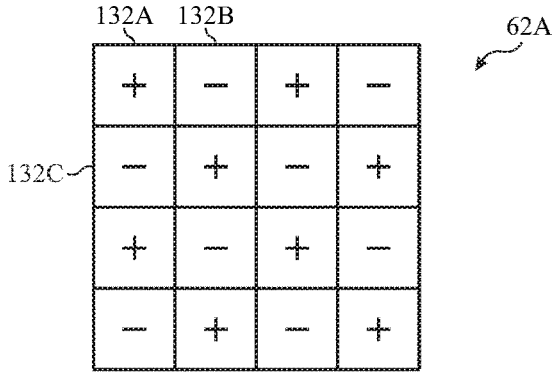
FIG. 13 is a diagrammatic representation of a polarity matrix used to determine the expected polarity, in accordance with an embodiment of the present disclosure.

To help illustrate, one example of a polarity matrix 62A is shown in FIG. 13. As depicted, the polarity matrix 62A indicates polarity of display pixels 46 at each location 132 in a 4×4 block. For example, the polarity matrix 62A indicates that a display pixel 46 at a first location 132A is to be written using a positive polarity, a display pixel 46 at a second location 132B is to be written using a negative polarity, a display pixel 46 at the third location 132C is to be written using a negative polarity, and so on. Thus, the polarity matrix 62A may be used to facilitate determining expected polarity when a dot inversion scheme is employed.

Returning to the process 124 of FIG. 12, the controller 42 may instruct the pixel response correction block 56 to map the polarity matrix 62 over the display panel 44 (process block 128). In some embodiments, the polarity matrix 62 may be mapped such the polarity matrix 62 is non-overlapping and/or adjacent neighbor mappings of the polarity matrix 62. In this manner, the controller 42 may instruct pixel response correction block 56 to determine expected polarity of a display pixel 46 based at least in part on location of the display pixel 46 in the polarity matrix 62 (process block 130).

Figure 14:
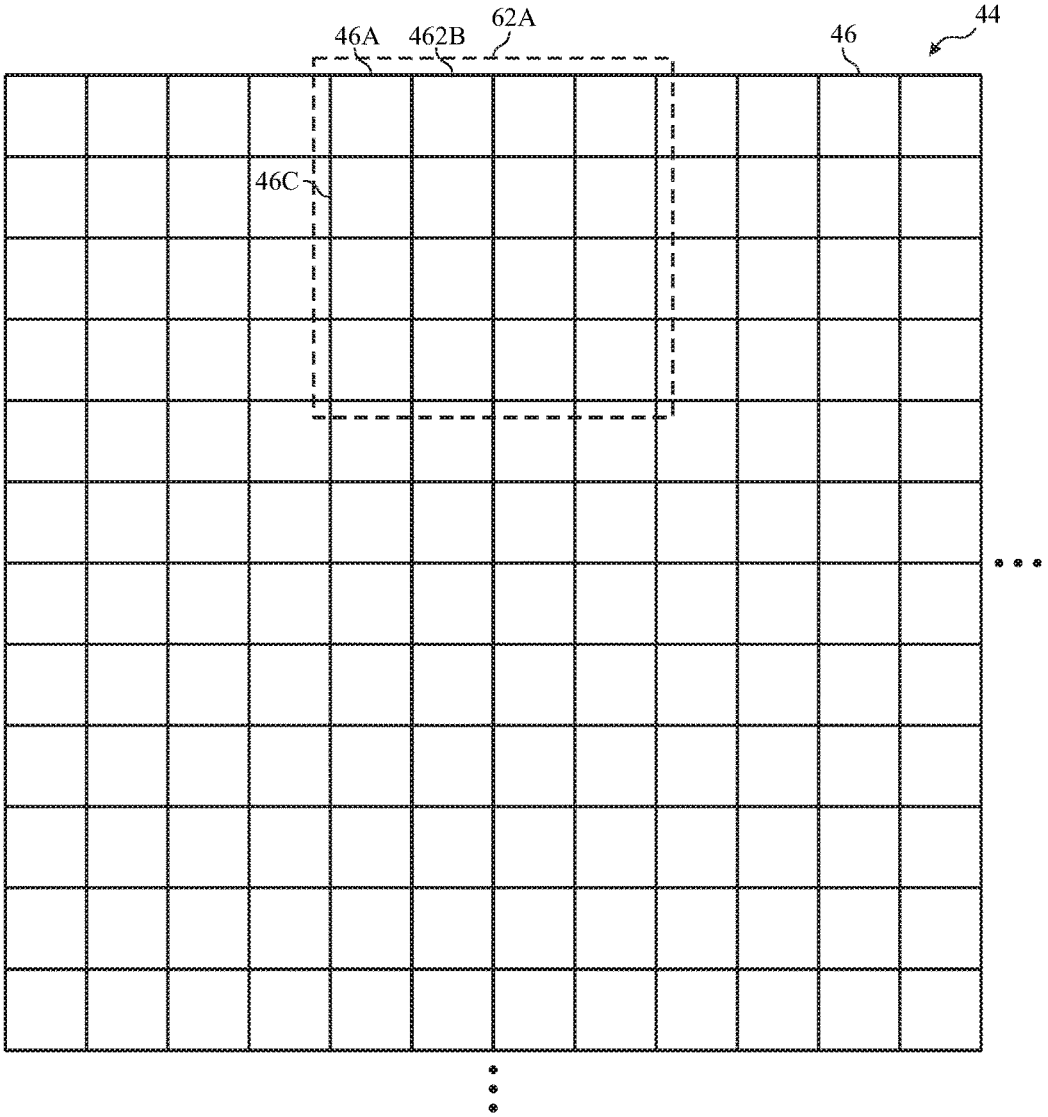
FIG. 14 is a diagrammatic representation of the polarity matrix of FIG. 13 mapped on a display panel, in accordance with embodiment of the present disclosure.

To help illustrate, a portion of a display panel 44 including an array of display pixels 46 is shown in FIG. 14. As depicted, the polarity matrix 62A is mapped over a 4×4 block of display pixels 46 on the display panel 44. In this manner, the polarity matrix 62A may indicate expected polarity of the display pixels in the 4×4 block. For example, the pixel response correction block 56 may determine that a first display pixel 46A has a positive expected polarity since located at a first location 132A in the polarity matrix 62A. Additionally, the pixel response correction block 56 may determine that a second display pixel 46B has a negative expected polarity since located at a second location 132B in the polarity matrix 62A, a third display pixel 46C has a negative expected polarity since located at a third location 132C in the polarity matrix 62A, and so on.

Returning to the process 114 of FIG. 11, the controller 42 may instruct the pixel response correction block 56 to select positive pixel response correction look-up-table 58 or negative pixel response correction look-up-table 58 based at least in part on the excepted polarity (process block 118). In particular, the pixel response correction block 56 may select a positive pixel response correction look-up-table 58 corresponding with each bit group when the display pixel 46 has a positive expected polarity. For example, the pixel response correction block 56 may select a positive MSB look-up-table 90 and a positive LSB look-up-table 92 when expected polarity is positive. On the other hand, the pixel response correction block 56 may select a negative pixel response correction look-up-table 58 corresponding with each bit group when the display pixel 46 has a negative expected polarity. For example, the pixel response correction block 56 may select a negative MSB look-up-table 90 and a negative LSB look-up-table 92 when expected polarity is negative.

As described above, in some embodiments, the positive look-up-tables 58 and the negative look-up-tables 58 corresponding to the expected operational parameters may both be stored in local storage of the pixel response correction block 56. For example, the pixel response correction block 56 may store both the positive MSB look-up-table 90 and the negative MSB look-up-table corresponding with the expected operational parameter set, thereby enabling the pixel response correction block 56 to selectively implement accordingly. Additionally or alternatively, the pixel response correction block 56 may store both the positive LSB look-up-table 92 and the negative MSB look-up-table 92B corresponding with the expected operational parameter set, thereby enabling the pixel response correction block 56 to selectively implement accordingly. In this manner, communication of pixel response correction look-up-tables 58 to the pixel response correction block 56 may be reduced while enabling the pixel response correction block 56 to account for difference in pixel response caused by polarity.

Additionally, the controller 42 may instruct the pixel response correction block 56 to convert each bit group in the input image data to a corresponding bit group in pixel response corrected image data (process block 120). For example, the pixel response correction block 56 may convert a MSB group (e.g., bits 8-13) of the input image data to a MSB group (e.g., bits 8-13) of the pixel response corrected image data using a selected (e.g., positive or negative) MSB look-up-table 90. Additionally, the pixel response correction block 56 may convert a LSB group (e.g., bits 0-7) of the input image data to a LSB group (e.g., bits 0-7) of the pixel response corrected image data using a selected (e.g., positive or negative) LSB look-up-table 92.

Thus, to determine the pixel response corrected image data, the controller 42 may instruct the pixel response correction block 56 to concatenate each of the bit groups of the pixel response corrected image data (process block 122). For example, to determine 14-bit pixel response corrected image data, the pixel response correction block 56 may concatenate the MSB group of the pixel response corrected image data and the LSB group of the pixel response corrected image data. In this manner, the pixel response correction block 56 may enable the display driver 40 to write an image frame based at least in part on pixel response corrected image data.

Accordingly, the technical effects of the present disclosure include improving displayed image quality of an electronic display by providing pixel response correction, for example, with reduced storage space, reduced power consumption, and/or reduced communication bandwidth. To facilitate, in some embodiments, each pixel response correction mapping used to compensate for expected pixel response may be implemented using multiple pixel response correction look-up-tables. Since relatively similar operational parameters may result in relatively similar expected pixel responses, some pixel response correction look-up-tables may be used to implement multiple different pixel response correction mappings, thereby reducing storage space used to store the pixel response correction look-up-tables and, thus, improving storage efficiency. Additionally, since operational parameters present may change gradually between successively display image frames, a pixel response correction look-up-table used to determine pixel response corrected image data for displaying a previous image frame may re-used to determine pixel response corrected image data for display a next subsequent image frame. In this manner, communication of pixel response correction look-up-tables may be reduced, thereby facilitating reducing communication bandwidth, reducing power consumption, and/or improving data communication efficiency.

The specific embodiments described above have been shown by way of example, and it should be understood that these embodiments may be susceptible to various modifications and alternative forms. It should be further understood that the claims are not intended to be limited to the particular forms disclosed, but rather to cover all modifications, equivalents, and alternatives falling within the spirit and scope of this disclosure.

What is claimed is:

1. An electronic device comprising:

an electronic display configured to display image frames, wherein the electronic display comprises a first display pixel and a display driver;

a display pipeline communicatively coupled to the display driver, wherein the display pipeline comprises pixel response correction processing circuitry configured to:

receive first input image data that indicates first target luminance of the first display pixel when displaying a first image frame on the electronic display;

convert the first input image data into first pixel response corrected image data by:

determining a first bit group in the first pixel response corrected image data by mapping a corresponding first bit group in the first input image data based at least in part on a first pixel response correction look-up-table; and determining a second bit group in the first pixel response corrected image data by mapping a corresponding second bit group in the first input image data based at least in part on a second pixel response correction look-up-table; and output the first pixel response corrected image data to enable the display driver to write the first display pixel based at least in part on the first pixel response corrected image data to facilitate displaying the first image frame on the electronic display.

2. The electronic device of claim 1, wherein:

the electronic display comprises a second display pixel; and the pixel response correction processing circuitry is configured to:

receive second input image data that indicates second target luminance of the second display pixel when displaying the first image frame on the electronic display;

convert the second input image data into second pixel response corrected image data by:

determining a third bit group in the second pixel response corrected image data by mapping a corresponding third bit group in the second input image data based at least in part on the first pixel response correction look-up-table; and determining a fourth bit group in the second pixel response corrected image data by mapping a corresponding fourth bit group in the second input image data based at least in part on the second pixel response correction look-up-table; and output the second pixel response corrected image data to the display driver to enable the display driver to facilitate displaying the first image frame by writing the second display pixel based at least in part on the second pixel response corrected image data.

3. The electronic device of claim 1, wherein the pixel response correction processing circuitry is configured to:

receive second input image data that indicates second target luminance of the first display pixel when display displaying a second image frame;

convert the second input image data into second pixel response corrected image data by:

determining third bit group in second pixel response corrected image data by mapping a corresponding third bit group in the second input image data based at least in part on the first pixel response correction look-up-table; and determining a fourth bit group in the second pixel response corrected image data by mapping a corresponding fourth bit group in the second input image data based at least in part on a third pixel response correction look-up-table different from the second pixel response correction look-up-table; and output the second pixel response corrected image data to the display driver to enable the display driver to facilitate displaying the second image frame by writing the first display pixel based at least in part on the second pixel response corrected image data.

4. The electronic device of claim 1, comprising a controller communicatively coupled to the display pipeline, wherein:

the controller is configured to determine operational parameters expected to be present when the first image frame is to be displayed on the electronic display; and the pixel response correction processing circuitry is configured to:

identify the first pixel response correction look-up-table and the second pixel response correction look-up-table based at least in part on the operational parameters expected to be present;

determine currently stored pixel response correction look-up-tables in local storage of the pixel response correction processing circuitry block;

receive the first pixel response correction look-up-table from an external storage device and store the first pixel response correction look-up-table in the local storage when the currently stored pixel response correction look-up-tables do not include the first pixel response correction look-up-table; and receive the second pixel response correction look-up-table from the external storage device and store the second pixel response correction look-up-table in the local storage when the currently stored pixel response correction look-up-tables do not include the second pixel response correction look-up-table.

5. The electronic device of claim 1, comprising a controller communicatively coupled to the display pipeline, wherein:

the controller is configured to determine operational parameters expected to be present when the first image frame is to be displayed on the electronic display; and the pixel response correction processing circuitry is configured to:

determine and store a first positive pixel response correction look-up-table and a first negative pixel response correction look-up-table in local storage of the pixel response correction processing circuitry based at least in part on the operational parameters expected to be present;

determine and store a second positive pixel response correction look-up-table and a second negative pixel response correction look-up-table in the local storage based at least in part on the operational parameters expected to be present;

determine expected polarity of an analog electrical signal to be generated by the display driver to write the first display pixel based at least in part on the first pixel response corrected image data;

select the first positive pixel response correction look-up-table as the first pixel response correction look-up-table and the second positive pixel response correction look-up-table as the second pixel response correction look-up-table when the expected polarity is positive; and select the first negative pixel response correction look-up-table as the first pixel response correction look-up-table and the second negative pixel response correction look-up-table as the second pixel response correction look-up-table when the expected polarity is negative.

6. The electronic device of claim 5, wherein, to determine the expected polarity, the pixel response correction processing circuitry is configured to:

determine a polarity matrix that indicates polarity of a group of display pixel locations based at least in part on an inversion scheme employed by the electronic display;

map the polarity matrix over a display panel in the electronic display; and determine the expected polarity based at least in part on location of the first display pixel in the polarity matrix.

7. The electronic device of claim 1, wherein the pixel response correction processing circuitry is configured to:

divide the first input image data into a most-significant-bit group and a least-significant-bit group;

input the most-significant-bit group into the first pixel response correction look-up-table to determine a corresponding most-significant-bit group in the first pixel response corrected image data;

input the least-significant-bit group into the second pixel response correction look-up-table to determine a corresponding least-significant-bit group in the first pixel response corrected image data; and determine the first pixel response corrected image data by concatenating the corresponding most-significant-bit group and the corresponding least-significant-bit group.

8. The electronic device of claim 7, wherein:

the first input image data comprises 14-bit gamma domain image data that indicates the first target luminance in a gamma domain;

the most-significant-bit group in the first input image data comprises bits 8-13 of the 14-bit gamma domain image data;

the least-significant-bit group in the first input image data comprises bits 0-7 of the 14-bit gamma domain image data;

the first pixel response corrected image data comprises 14-bit pixel response corrected image data that offsets variations in expected pixel response of the first display pixel;

the corresponding most-significant-bit group in the first pixel response corrected image data comprises bits 8-13 of the 14-bit pixel response corrected image data; and the corresponding least-significant-bit group in the first pixel response corrected image data comprises bits 0-7 of the 14-bit pixel response corrected image data image data.

9. The electronic device of claim 1, wherein the display pipeline comprises gamma convert processing circuitry communicatively coupled to the pixel response correction processing circuitry, wherein the gamma convert processing circuitry is configured to:

receive linear domain image data that indicates the first target luminance of the first display pixel in a linear domain; and determine the first input image data by converting the linear domain image data to gamma domain image data that indicates the first target luminance in a gamma domain.

10. The electronic device of claim 1, wherein the electronic device comprises a portable phone, a media player, a personal data organizer, a handheld game platform, a tablet device, a computer, or any combination thereof.

11. A method for operating a display pipeline, comprising:

receiving, using the display pipeline, first linear domain image data that indicates a first target luminance of a first display pixel used to display a first image frame on an electronic display from an image data source;

converting, using the display pipeline, the first linear domain image data into first gamma domain image data that indicates the first target luminance in a gamma domain;

dividing, using the display pipeline, bits of the first gamma domain image data into a first bit group and a second bit group;

identifying and storing, using the display pipeline, a first pixel response correction look-up-table and a second pixel response correction look-up-table in local storage of the display pipeline based at least in part on first expected operational parameters when the first image frame is to be displayed;

converting, using the display pipeline, the first gamma domain image data into first pixel response corrected image data by mapping the first bit group based at least in part on the first pixel response correction look-up-table and mapping the second bit group based at least in part on the second pixel response correction look-up-table; and outputting, using the display pipeline, the first pixel response corrected image data to a display driver to enable the display driver to write the first display pixel based at least in part on the first pixel response corrected image data when the first image frame is to be displayed.

12. The method of claim 11, wherein converting the first gamma domain image data into the first pixel response corrected image data comprises:

mapping a first most-significant-bit group of the first gamma domain image data to a second most-significant-bit group of the first pixel response corrected image data, wherein bit-depth of the first most-significant-bit group is equal to bit-depth of the second most-significant-bit group;

mapping a first least-significant-bit group of the first gamma domain image data to a second least-significant-bit group of the first pixel response corrected image data, wherein bit-depth of the first least-significant-bit group is equal to bit-depth of the second least-significant-bit group; and concatenating the second most-significant-bit group in front of the second least-significant-bit group.

13. The method of claim 11, wherein identifying and storing the first pixel response correction look-up-table and the second pixel response correction look-up-table comprises:

identifying the first pixel response correction look-up-table and the second pixel response correction look-up-table based at least in part on the first expected operational parameters;

determining pixel response correction look-up-tables currently stored in the local storage of the display pipeline;

receiving the first pixel response correction look-up-table from an external storage device and storing the first pixel response correction look-up-table in the local storage when the pixel response correction look-up-tables currently stored in the local storage do not include the first pixel response correction look-up-table; and receiving the second pixel response correction look-up-table from the external storage device and storing the second pixel response correction look-up-table in the local storage when the pixel response correction look-up-tables currently stored in the local storage do not include the second pixel response correction look-up-table.

14. The method of claim 11, comprising:

receiving, using the display pipeline, second linear domain image data that indicates a second target luminance of the first display pixel used to display a second image frame on the electronic display directly after the first image frame from the image data source;

converting, using the display pipeline, the second linear domain image data into second gamma domain image data that indicates the second target luminance in the gamma domain;

dividing, using the display pipeline, bits of the second gamma domain image data into a third bit group and a fourth bit group, wherein bit-depth of the third bit group is equal to bit depth of the first bit group and bit-depth of the fourth bit group is equal to bit-depth of the second bit group;

receiving, using the display pipeline, a third pixel response correction look-up-table different from the second pixel response correction look-up-table from an external storage device based at least in part on second expected operational parameters when the second image frame is to be displayed;

storing, using the display pipeline, the third pixel response correction look-up-table in the local storage by overwriting the second pixel response correction look-up-table;

converting, using the display pipeline, the second gamma domain image data into second pixel response corrected image data by mapping the third bit group based at least in part on the first pixel response correction look-up-table and the fourth bit group based at least in part on the third pixel response correction look-up-table; and outputting, using the display pipeline, the second pixel response corrected image data to the display driver to enable the display driver to write the first display pixel based at least in part on the second pixel response corrected image data when the second image frame is to be displayed.

15. The method of claim 11, wherein:

storing the first pixel response correction look-up-table and the second pixel response correction look-up-table comprises:

storing a positive most-significant-bit look-up-table and a negative most-significant-bit look-up-table based at least in part on the first expected operational parameters; and storing a positive least-significant-bit look-up-table and a negative least-significant-bit look-up-table based at least in part on the first expected operational parameters; and converting the first gamma domain image data into the first pixel response corrected image data comprises:

determining polarity of an analog electrical signal expected to be generated by the display driver to write the first display pixel in the first image frame;

selecting the positive most-significant-bit look-up-table as the first pixel response correction look-up-table and the positive least-significant-bit look-up-table as the second pixel response correction look-up-table when the polarity is expected to be positive; and selecting the negative most-significant-bit look-up-table as the first pixel response correction look-up-table and the negative least-significant-bit look-up-table as the second pixel response correction look-up-table when the polarity is expected to be negative.

16. The method of claim 15, wherein determining the polarity of the analog electrical signal expected to be generated by the display driver comprises:

determining a polarity matrix based at least in part on an inversion scheme employed by the electronic display;

mapping the polarity matrix over a display panel in the electronic display; and determining the polarity expected to be generated based at least in part on location of the first display pixel in an instance of the polarity matrix mapped over the display panel.

17. The method of claim 11, wherein:

receiving the first linear domain image data comprise receiving 8-bit or 10-bit linear domain image data;

converting the first linear domain image data into the first gamma domain image data comprises converting the first linear domain image data into 14-bit gamma domain image data;

dividing the bits of the first gamma domain image data comprises dividing bits 8-13 of the 14-bit gamma domain image data into the first bit group and bits 0-7 of the 14-bit gamma domain image data into the second bit group;

storing the first pixel response correction look-up-table comprises storing a 6-bit pixel response correction look-up-table in the local storage;

storing the second pixel response correction look-up-table comprise storing an 8-bit pixel response correction look-up-table in the local storage; and converting the first gamma domain image data into the first pixel response corrected image data comprises determining 14-bit pixel response corrected image data by:

determining bits 8-13 of the 14-bit pixel response corrected image data based at least in part on bits 8-13 of the 14-bit gamma domain image data and the 6-bit pixel response correction look-up-table; and determining bits 0-7 of the 14-bit pixel response corrected image data based at least in part on bits 0-7 of the 14-bit gamma domain image data and the 8-bit pixel response correction look-up-table.

18. A tangible, non-transitory, computer-readable medium that stores instructions executable by one or more processors of an electronic device, wherein the instructions comprise instructions to:

determine, using the one or more processors, expected value of one or more operational parameters that affect pixel response of display pixels on an electronic display when displaying an image frame;

determine, using the one or more processors, a pixel response correction mapping expected to offset variations in the pixel response caused by changes in the one or more operational parameters;

determine, using the one or more processors, a plurality of pixel response correction look-up-tables used to implement the pixel response correction mapping;

determine, using the one or more processors, which of the plurality of pixel response correction look-up-tables are currently stored in local storage of a display pipeline;

instruct, using the one or more processors, the display pipeline to retrieve each of the plurality of pixel response correction look-up-tables not currently stored in the local storage from an external storage device; and instruct, using the one or more processors, the display pipeline to convert initial image data corresponding with the image frame into pixel response corrected image data to be used by a display driver to write the image frame based at least in part on each of the plurality of pixel response correction look-up-tables.

19. The computer-readable medium of claim 18, wherein:

the instructions to determine the plurality of pixel response correction look-up-tables comprises instructions to determine a most-significant-bit look-up-table and a least-significant-bit look-up-table; and the instructions to instruct the display pipeline to convert the initial image data into the pixel response corrected image data comprises instructions to:

instruct the display pipeline to use the most-significant-bit look-up-table to determine a most-significant-bit group of the pixel response corrected image data;

instruct the display pipeline to use the least-significant-bit look-up-table to determine a least-significant-bit group of the pixel response corrected image data; and instruct the display pipeline to concatenate the most-significant-bit group and the least-significant-bit group.

20. The computer-readable medium of claim 18, wherein the instructions to determine the expected value of the one or more operational parameters comprise instructions to:

determine expected charge accumulation in the display pixels resulting from displaying one or more previous image frames;

determine expected display duration of the image frame based at least in part on display duration of the one or more previous image frames;

determine expected refresh rate of the image frame based at least in part on refresh rate of the one or more previous image frames;

determine expected environmental conditions based at least in part on sensor data received from one or more sensors;

determine expected backlight luminance used to display the image frame based at least in part on ambient light conditions; or any combination thereof.

* * * * *